US009409042B2

(12) United States Patent
Na

(10) Patent No.: US 9,409,042 B2
(45) Date of Patent: Aug. 9, 2016

(54) EMERGENCY ESCAPE DEVICE

(75) Inventor: Pan Ju Na, Seoul (KR)

(73) Assignee: ASIA FIRE PROTECTION CO., LTD., Seoul (KR)

( * ) Notice: Subject to any disclaimer, the term of this patent is extended or adjusted under 35 U.S.C. 154(b) by 735 days.

(21) Appl. No.: 13/638,079

(22) PCT Filed: Mar. 29, 2011

(86) PCT No.: PCT/KR2011/002122

§ 371 (c)(1),
(2), (4) Date: Dec. 5, 2012

(87) PCT Pub. No.: WO2011/122817

PCT Pub. Date: Oct. 6, 2011

(65) Prior Publication Data

US 2013/0206509 A1 Aug. 15, 2013

(30) Foreign Application Priority Data

Apr. 2, 2010 (KR) ..... 10-2010-0030165
Jul. 8, 2010 (KR) ..... 10-2010-0065782
Feb. 14, 2011 (KR) ..... 10-2011-0012870

(51) Int. Cl.
*E04G 1/18* (2006.01)
*A62B 1/02* (2006.01)
(Continued)

(52) U.S. Cl.
CPC ... *A62B 1/02* (2013.01); *B66B 9/00* (2013.01); *B66B 9/025* (2013.01); *B66B 11/00* (2013.01)

(58) Field of Classification Search
CPC ..... E04G 1/22; E04G 1/20; A62B 1/02; B66B 11/00; B66B 11/0407; B66B 11/0055; B66B 7/062; B66B 9/00; B66B 9/187
See application file for complete search history.

(56) References Cited

U.S. PATENT DOCUMENTS 314,736 A * 3/1885 Smith ..... B66B 11/04 187/259
996,933 A * 7/1911 Lindquist ..... B66B 11/04 187/277

(Continued)

FOREIGN PATENT DOCUMENTS

CA 2365885 A1 * 6/2002 ..... A62B 1/22
CH 703855 A2 * 3/2012 ..... A62B 1/02

(Continued)

OTHER PUBLICATIONS

PCT International Search Report of Application No. PCT/KR2011/002122, dated Dec. 28, 2011.

*Primary Examiner* — Katherine Mitchell
*Assistant Examiner* — Candace L Bradford
(74) *Attorney, Agent, or Firm* — Kile Park Reed & Houtteman PLLC

(57) ABSTRACT

An emergency escape device includes an escape hole cap fitted from above to an escape hole of a fire evacuation area of a high-rise building so as to cover an inner edge of the escape hole, a guide unit vertically installed to extend above and below the escape hole cap, a descending unit positioned below the escape hole cap and slidably attached to the guide unit in such a manner as to descend along the guide unit, a slowing unit configured to ensure that the descending unit descends along the guide unit at a reduced speed, and a returning unit for returning the descending unit descended along the guide unit to an original position. The emergency escape device may further include a locking unit for keeping the descending unit against downward movement in an upper portion of the guide unit.

4 Claims, 21 Drawing Sheets

(51) Int. Cl.

| | |
|---|---|
| ***B66B 9/00*** | (2006.01) |
| ***B66B 9/02*** | (2006.01) |
| ***B66B 11/00*** | (2006.01) |

(56) References Cited

U.S. PATENT DOCUMENTS

| | | | | | |
|---|---|---|---|---|---|
| 1,107,191 | A * | 8/1914 | Balliet | B66B 7/068 | 187/405 |
| 2,169,602 | A * | 8/1939 | Doggett | B66B 11/04 | 188/171 |
| 3,799,290 | A * | 3/1974 | Fisher | B66F 7/20 | 182/148 |
| 5,203,619 | A * | 4/1993 | Welsch | B65G 1/0464 | 312/242 |
| 5,368,131 | A * | 11/1994 | Yoshihiro | A62B 1/02 | 187/301 |
| 5,501,295 | A * | 3/1996 | Muller | B66B 9/00 | 187/403 |
| 5,906,252 | A * | 5/1999 | Wang | B66B 5/028 | 187/263 |
| 2005/0098387 | A1 * | 5/2005 | Penn | B66B 11/06 | 187/262 |
| 2006/0000675 | A1 * | 1/2006 | Penn | B66B 9/00 | 182/142 |
| 2007/0114098 | A1 * | 5/2007 | Hartley | B66B 9/00 | 187/259 |
| 2007/0246694 | A1 * | 10/2007 | Lee | A62B 1/02 | 254/318 |
| 2008/0302605 | A1 * | 12/2008 | St-Germain | E04G 1/20 | 182/223 |
| 2010/0051888 | A1 * | 3/2010 | Taylor | B66D 1/26 | 254/286 |
| 2011/0042167 | A1 * | 2/2011 | Bai | A62B 1/02 | 182/142 |

FOREIGN PATENT DOCUMENTS

| | | | | |
|---|---|---|---|---|
| FI | WO 2011148033 | A1 * | 12/2011 | B66B 19/005 |
| FI | WO 2012089896 | A1 * | 7/2012 | B66B 19/002 |
| JP | 06-039046 | A | 2/1994 | |
| JP | 2003-118951 | A | 4/2003 | |
| KR | 20-1994-0005847 | Y1 | 8/1994 | |
| KR | 20-0338199 | Y1 | 1/2004 | |
| WO | WO 2011148033 | A1 * | 12/2011 | |
| WO | WO 2012089896 | A1 * | 7/2012 | |

* cited by examiner

EMERGENCY ESCAPE DEVICE

FIELD OF THE INVENTION

The present invention relates to an emergency escape device and, more particularly, to an emergency escape device that can enable rapid escape of evacuees by ensuring that a descending unit installed in an escape hole of a fire evacuation area descends along a guide unit at a reduced speed when an emergency evacuation situation such as fire or the like occurs in a high-rise building.

BACKGROUND OF THE INVENTION

In general, a slow descending device is extensively used as an emergency escape device. A stairway or an elevator cannot be used when an emergency situation such as fire or the like occurs in a high-rise building such as an apartment, a hotel or a hospital. In order to cope with this situation, the slow descending device is installed in a window or a porch. The slow descending device is a safety escape mechanism designed to enable an evacuee to slowly descend along a descending rope by his or her weight. In other words, the slow descending device has been developed to enable safe escape of evacuees in the event that the evacuees cannot escape through a typical doorway due to fire and so forth. Evacuees of all ages and sexes can escape to the bottom floor of a high-rise building by getting on the slow descending device, fastening a seat belt and allowing the slow descending device to descend by the weight of the evacuees.

The conventional emergency escape device is used in the following manner. In the event of an emergency situation, an evacuee holds a slow descending device and a reel and moves toward a window or a porch. The evacuee fastens a clamp of the slow descending device to an anchor fixed to a building. After fastening a seat belt connected to one end of a rope, the evacuee throws the reel out of the building so that the rope wound on the reel can be unwound. In this state, the evacuee jumps down from a porch or a window. Since the rope is slowly unwound by the slow descending device, the evacuee hanging on the rope through the seat belt can slowly descend and can make a safe landing on the ground floor.

However, the conventional emergency escape device has a problem in that two or more evacuees cannot successively escape using the slow descending device installed in one escape space. If one of the evacuees uses the emergency escape device, the remaining evacuees have to wait until the seat belt comes back to the original position. This makes it difficult for the evacuees to successively and rapidly escape from a building.

In case of the conventional emergency escape device, a rope is used for an evacuee to descend from an upper stair to the ground floor. This poses a problem in that, under the influence of wind or for other causes, the evacuee may collide with a building wall, a signboard or a window frame and may get injured.

SUMMARY OF THE INVENTION

It is therefore an object of the present invention to provide an emergency escape device that can enable safe and rapid escape of evacuees by ensuring that a descending unit installed in an escape hole of a fire evacuation area descends along a guide unit at a reduced speed when an emergency evacuation situation such as fire or the like occurs in a high-rise building.

Another object of the present invention is to provide an emergency escape device capable of enabling evacuees to successively and rapidly escape from a building by ensuring that a descending unit moved down along a guide unit can quickly come back to an original position.

In accordance with the present invention, there is provided an emergency escape device including: an escape hole cap fitted from above to an escape hole of a fire evacuation area of a high-rise building so as to cover an inner edge of the escape hole; a guide unit vertically installed to extend above and below the escape hole cap; a descending unit positioned below the escape hole cap and slidably attached to the guide unit in such a manner as to descend along the guide unit; a slowing unit configured to ensure that the descending unit descends along the guide unit at a reduced speed; and a returning unit for returning the descending unit descended along the guide unit to an original position. The emergency escape device may further include: a locking unit for keeping the descending unit against downward movement in an upper portion of the guide unit.

With the emergency escape device of the present invention, it is possible to enable rapid escape of evacuees by ensuring that a descending unit installed in an escape hole of a fire evacuation area descends along a guide unit at a reduced speed when an emergency evacuation situation such as fire or the like occurs in a high-rise building.

Moreover, the emergency escape device of the present invention enables evacuees to successively and rapidly escape from a building by ensuring that a descending unit moved down along a guide unit can quickly come back to the original position.

Inasmuch as the emergency escape device is permanently installed in a fire evacuation area of a building, it is possible for evacuees to rapidly and safely escape from the building in the event of an emergency situation without having to bring a separate emergency escape device to the fire evacuation area.

Since a spiral spring type winder is used as a returning unit for returning a descending unit to the original position, it is possible to reduce the manufacturing cost of the emergency escape device and to restrain generation of noises during the operation of the emergency escape device.

DETAILED DESCRIPTION OF THE PREFERRED EMBODIMENTS

Certain preferred embodiments of the present invention will now be described in detail with reference to the accompanying drawings.

Figure 1:
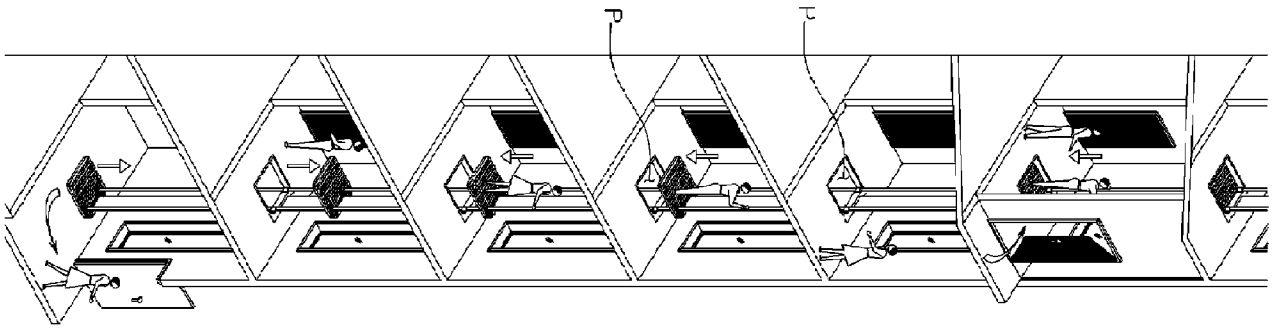
FIG. 1 is a view illustrating one example of a high-rise building to which an emergency escape device according to a first preferred embodiment of the present invention is applied.
Figure 2:
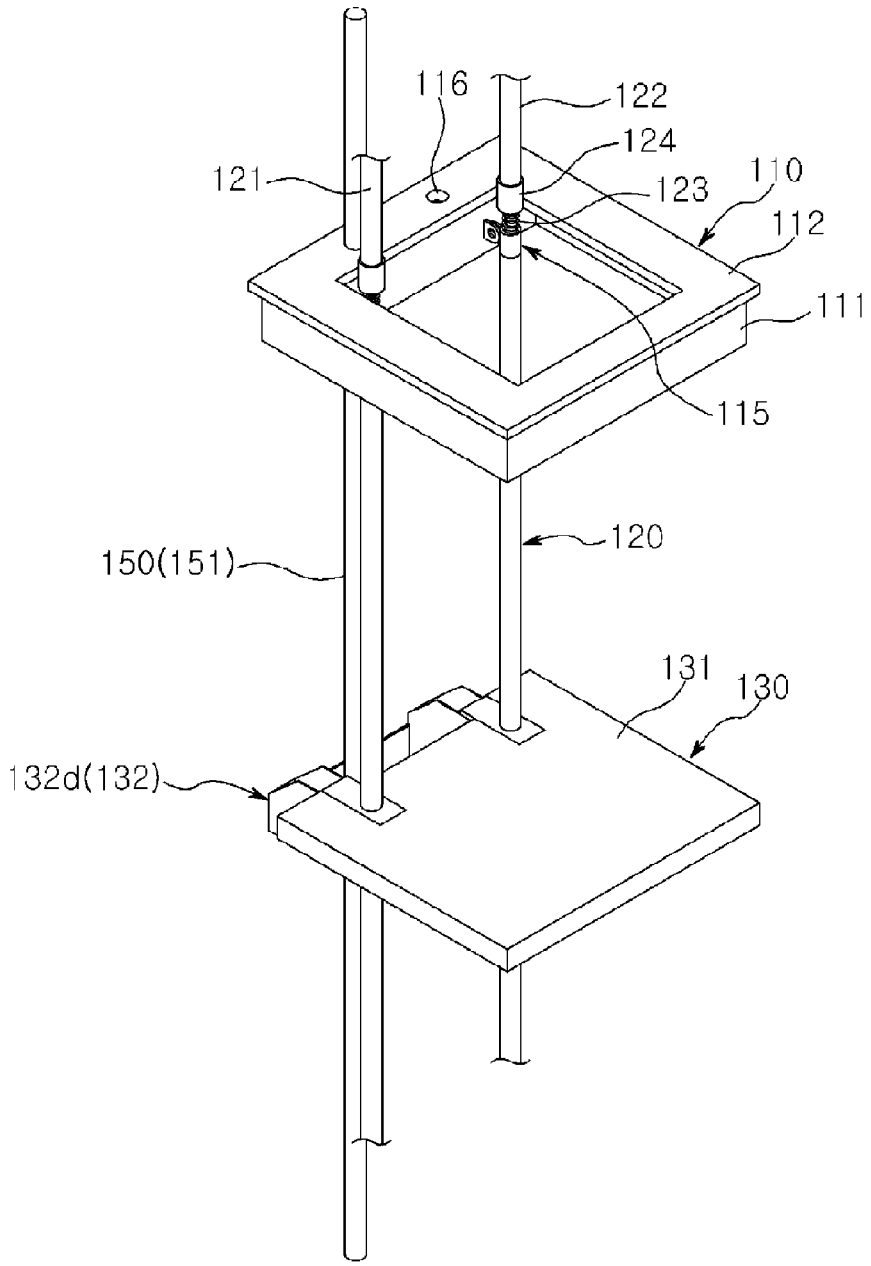
FIG. 2 is a perspective view of the emergency escape device shown in FIG. 1.
Figure 3:
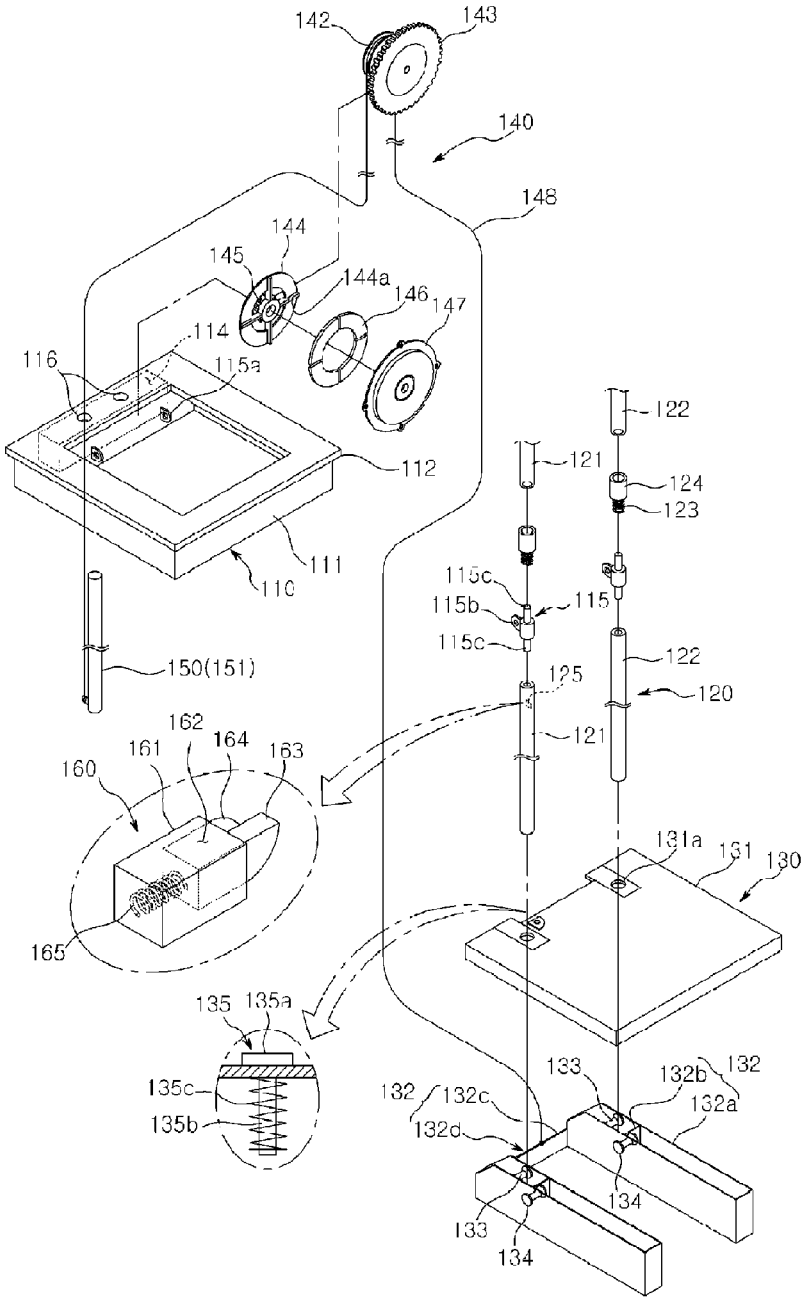
FIG. 3 is an exploded perspective view of the emergency escape device shown in FIG. 1.
Figure 4:
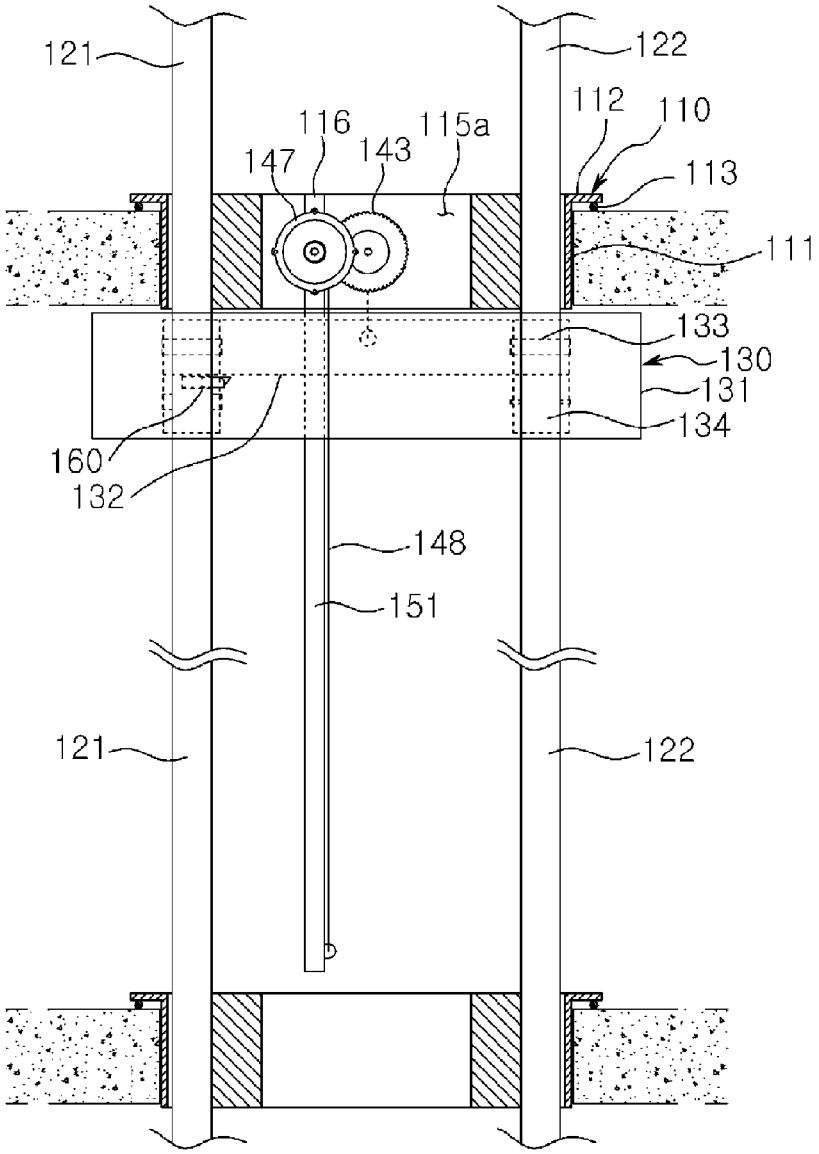
FIGS. 4, 5 and 6 are front, side and top transparent section views schematically illustrating the emergency escape device shown in FIG. 1.
Figure 5:
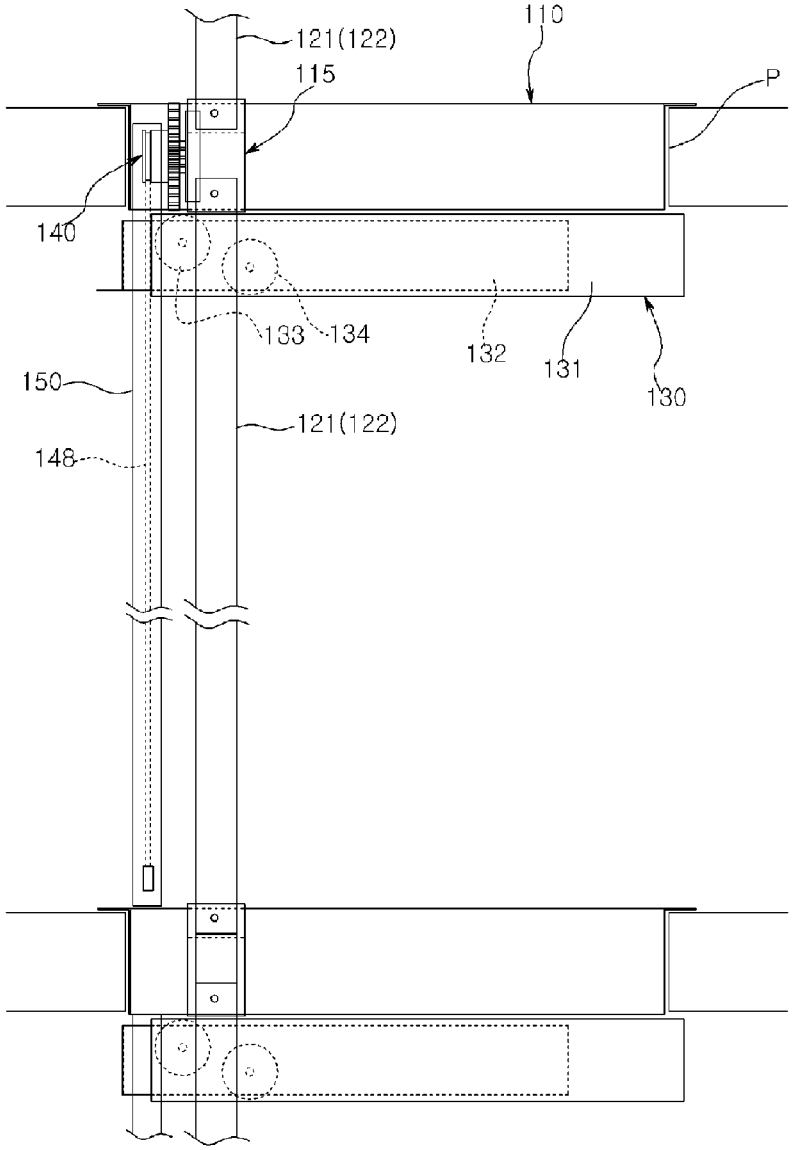
Figure 6:
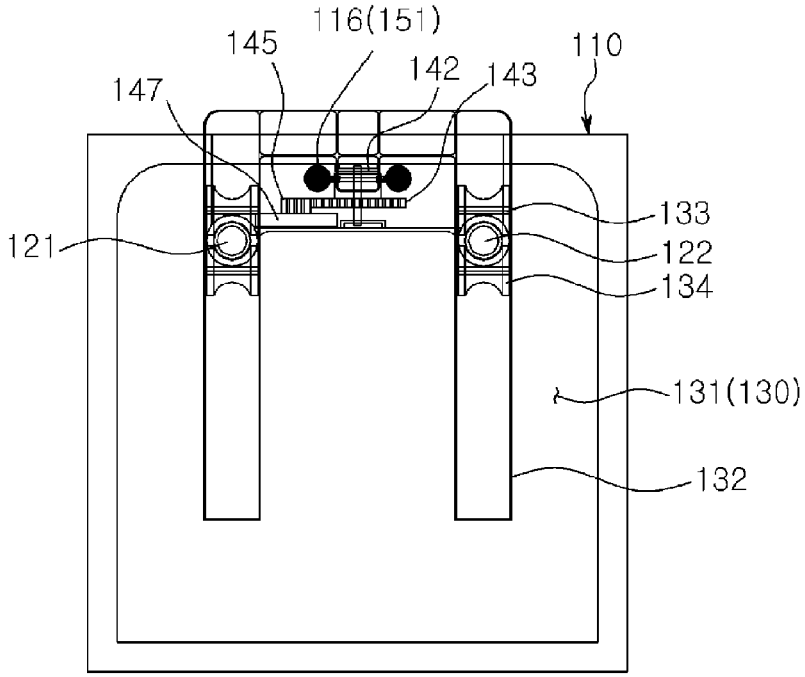

FIG. 1 is a view illustrating one example of a high-rise building to which an emergency escape device according to a first preferred embodiment of the present invention is applied. FIG. 2 is a perspective view of the emergency escape device shown in FIG. 1. FIG. 3 is an exploded perspective view of the emergency escape device shown in FIG. 1. FIGS. 4, 5 and 6 are front, side and top transparent section views schematically illustrating the emergency escape device shown in FIG. 1.

As shown in FIGS. 1 through 6, the emergency escape device according to a first preferred embodiment of the present invention includes: an escape hole cap 110 fitted from above to an escape hole P of a fire evacuation area of a high-rise building so as to cover an inner edge of the escape hole P; a guide unit 120 vertically installed to extend above and below the escape hole cap 110; a descending unit 130 positioned below the escape hole cap 110 and slidably attached to the guide unit 120 in such a manner as to descend along the guide unit 120; a slowing unit 140 configured to ensure that the descending unit 130 descends along the guide unit 120 at a reduced speed; a returning unit 150 for returning the descending unit 130 descended along the guide unit 120 to an original position; and a locking unit 160 for keeping the descending unit 130 against downward movement in an upper portion of the guide unit 120.

In this regard, the fire evacuation area is a safe evacuation area provided in, e.g., an inter-household balcony border of an apartment. The fire evacuation area has an escape hole P through which an upper story and a lower story communicate with each other so that an evacuee can escape from the upper story to the lower story through the escape hole P using the emergency escape device.

The escape hole cap 110 is fitted from above to the escape hole P formed in the floor surface of the fire evacuation area so as to cover an inner edge of the escape hole P. The escape hole cap 110 includes: an insertion body 111 having a length substantially equal to the thickness of a floor in which the escape hole P is formed; a flange 112 formed to protrude from an upper end of the insertion body 111 and supported by the floor surface around the escape hole P when the insertion body 111 is inserted into the escape hole P; a shock absorber (not shown) arranged on a lower surface of the flange 112 to absorb shocks applied to the escape hole cap 110; a slowing unit reception compartment 114 formed inside the insertion body 111 to receive the slowing unit 140; and a support bracket 115 attached to a partition wall defining the slowing unit reception compartment 114 and configured to vertically support the guide unit 120 positioned above and below the escape hole P.

In this regard, it is preferred that the slowing unit reception compartment 114 be closed by a panel or the like after the slowing unit 140 is received within the slowing unit reception compartment 114. The support bracket 115 includes an anchor piece 115*a* fixed to the partition wall defining the slowing unit reception compartment 114, a connector piece 115*b* bolted to the anchor piece 115*a* and a pair of upper and lower insertion pins 115*c* fixed to the connector piece 115*b* and fitted to the guide unit 120.

With the escape hole cap 110 set forth above, the insertion body 111 is inserted from above to the escape hole P formed on the floor surface of a specific story. This helps prevent the body of an evacuee from being scratched by the edge of the escape hole P when the evacuee escapes through the use of the descending unit 130. The shock absorber (not shown) of the escape hole cap 110 absorbs shocks applied to the escape hole cap 110 when another descending unit 130 descends from the upper story and makes contact with the escape hole cap 110. This makes it possible to prevent occurrence of a safety accident.

The guide unit 120 is vertically installed above and below the escape hole cap 110 so that the descending unit 130 can safely descend and ascend along the guide unit 120. The guide unit 120 includes a pair of guide frames 121 and 122 attached to the upper and lower insertion pins 115*c* of the support bracket 115. Each of the guide frames 121 and 122 has a length substantially equal to the height of the fire evacuation area.

Prior to fitting each of the guide frames 121 and 122 to the upper insertion pin 115*c* of the support bracket 115, a shock absorbing spring 123 and a sleeve 124 are fitted to the upper insertion pin 115*c* of the support bracket 115. The shock absorbing spring 123 serves to absorb shocks applied to the descending unit 130 that descends along each of the guide frames 121 and 122. The sleeve 124 is fixed to the upper end of the shock absorbing spring 123 and is configured to receive the lower end portion of each of the guide frames 121 and 122.

With the guide unit 120 set forth above, the guide frames 121 and 122 are fitted to the upper and lower insertion pins 115*c* of the support bracket 115 of the escape hole cap 110. The escape hole cap 110 is supported on the floor surface around the escape hole P. This makes it possible to keep the guide frames 121 and 122 stable when an evacuee escapes using the descending unit 130. The guide frames 121 and 122 can be easily installed by merely fitting the guide frames 121 and 122 to the upper and lower insertion pins 115*c* of the support bracket 115.

In this regard, each of the guide frames 121 and 122 has a length substantially equal to the distance between the escape hole caps 110 installed in the upper and lower stories of a building, i.e., the height of a specific story of the building. Since the guide frames 121 and 122 are removably attached to the upper and lower insertion pins 115*c* of the support bracket 115, it becomes easy to perform a task of connecting the escape hole cap 110 and the guide frames 121 and 122.

One of the guide frames 121 and 122 has an installation hole 125 formed in the uppermost portion thereof. The locking unit 160 is installed within the installation hole 125 so as to lock or release the descending unit 130.

When the descending unit 130 descends toward the floor surface of the lower story, an evacuee can grip each of the guide frames 121 and 122. This enables the evacuee to escape safely. It is preferred that the open space between the support bracket 115 and the guide frames 121 and 122 be closed by a decoration panel (not shown) so as to improve the external appearance of the escape hole cap 110 while interconnecting the guide frames 121 and 122.

With the guide unit 120 set forth above, the descending unit 130 can move down along each of the guide frames 121 and 122 attached to the support bracket 115 of the escape hole cap 110 installed in the escape hole P. Therefore, unlike the conventional emergency escape device in which an evacuee escapes through the use of a rope, the descending unit 130 does not sway under the influence of wind. This makes it possible to prevent the evacuee from colliding with the objects on the outer wall of a building and eventually getting injured.

The descending unit 130 is mounted to the guide unit 120 so as to make contact with the lower end of the insertion body 111 of the escape hole cap 110 or the ceiling of a specific story having the escape hole P. The descending unit 130 is configured to descend along the guide unit 120. The descending unit 130 includes: a descending panel 131 having a pair of through-holes 131*a* corresponding in shape to the guide frames 121 and 122 of the guide unit 120; a base frame 132 including a pair of embedment portions 132*a* embedded in the descending panel 131, the base frame 132 having guide holes 132*b* formed in the embedment portions 132*a* in alignment with the through-holes 131*a* of the descending panel 131, the guide frames 121 and 122 fitted to the guide holes 132*b* of the base frame 132, the base frame 132 further including a connecting portion 132*c* connected to the slowing unit 140 and an open portion 132*d* defined between the embedment portions 132*a;* first and second guide rollers 133 and 134 rotatably attached to the embedment portions 132*a* so as to make rolling contact with the guide frames 121 and 122 inserted into the guide holes 132*b;* and a release button 135 provided in the descending panel 131 so as to release the locking unit 160 for having the descending panel 131 locked in an upper portion of one of the guide frames 121 and 122.

Preferably, the descending panel 131 is a durable light panel having a specified thickness and an area larger than the escape hole P. The descending panel 131 is formed of an upper board, a lower board and a honeycomb-like intermediate board, which are bonded to each other or formed into one piece. If necessary, an auxiliary panel (not shown) corresponding in shape and size to the inner space of the insertion body 111 of the escape hole cap 110 may be attached to the upper surface of the descending panel 131.

The first and second guide rollers 133 and 134 making rolling contact with the guide frames 121 and 122 are formed into a well-known shape and configuration so that the friction between the first and second guide rollers 133 and 134 and the guide frames 121 and 122 can be minimized. The first and second guide rollers 133 and 134 are preferably kept spaced apart from the guide frames 121 and 122 by a specified distance.

The release button 135 includes: a head 135*a* that can be pressed by the foot of an evacuee who gets on the descending panel 131 to escape to a lower story in the event of an emergency situation; a pressing shaft 135*b* extending from the head 135*a* to vertically penetrate the descending panel 131, the pressing shaft 135*b* configured to, when the head 135*a* is pressed, move down and press a slant push-back portion 164 of the locking unit 160 so that a sliding body 162 of the locking unit 160 can be retracted into the installation hole 125 of one of the guide frames 121 and 122; and a biasing spring 135*c* arranged within the descending panel 131 to surround the pressing shaft 135*b,* the biasing spring 135*c* configured to bias the pressing shaft 135*b* upward. In this regard, an entrance hole 131*b* through which the sliding body 162 of the locking unit 160 can move is formed the side wall of the descending panel 131 near the release button 135.

With the descending unit 130 configured as above, the descending panel 131 can descend along the guide frames 121 and 122 installed in the fire evacuation area of a high-rise building, whereby an evacuee can safely escape from an upper story to a lower story with no likelihood of collision with a building wall or the like. The slowing unit 140 serves to ensure that the descending unit 130 descends along the guide unit 120 at a reduced speed. The slowing unit 140 includes: a housing (not shown) arranged in the slowing unit reception compartment 114 formed inside the insertion body 111 of the escape hole cap 110; a large gear 143 rotatably installed within the housing and provided with a pulley 142; a small gear 145 rotatably installed within the housing to mesh with the large gear 143 and provided with a speed reducing wheel 144; a plurality of speed reducing pieces 146 radially arranged in the speed reducing wheel 144 to receive centrifugal forces; a speed reducing cover 147 fixed to the housing and arranged to surround the speed reducing wheel 144 and the speed reducing pieces 146; and a rope 148 wound around the pulley 142, the rope 148 having a first end portion drawn out from a lower portion of the housing and fixed to the connecting portion 132*c* of the base frame 132 of the descending unit 130 and a second end portion drawn out from the lower portion of the housing and connected to a weight 151 of the returning unit 150 positioned near the guide frames 121 and 122.

In this connection, the housing can be stably fixed to the escape hole cap 110 by a fastener (not shown). Preferably, the housing has a drawing-out hole (not shown) through which the first and second end portions of the rope 148 can be drawn out.

The large gear 143 is rotatably installed within the housing and is rotated by the frictional force of the rope 148 in the event of emergency evacuation. The large gear 143 is provided with a pulley 142 around which the rope 148 can be wound. The large gear 143 has a central shaft hole to which a shaft is fitted. Preferably, the pulley 142 is one-piece formed with the large gear 143.

The small gear 145 is rotatably installed within the housing to mesh with the large gear 143 and is rotated by the large gear 143 in the event of emergency evacuation. The small gear 145 is provided with a speed reducing wheel 144 for applying brake to the large gear 143. The speed reducing wheel 144 has a plurality of partition ribs 144*a* for isolating the speed reducing pieces 146 from one another. The small gear 145 has a central shaft hole to which a shaft is fitted. Preferably, the speed reducing wheel 144 is one-piece formed with the small gear 145.

The speed reducing pieces 146 are radially arranged between the partition ribs 144*a* of the speed reducing wheel 144 to receive centrifugal forces. The speed reducing pieces 146 plays the role of a brake device when the descending unit 130 is moved down. During rotation of the speed reducing wheel 144, the speed reducing pieces 146 are pushed radially outward by centrifugal forces to make frictional contact with the inner surface of the speed reducing cover 147, thereby applying brake to the speed reducing wheel 144.

The speed reducing cover 147 is arranged to surround the speed reducing wheel 144 and the speed reducing pieces 146.

The speed reducing cover 147 has central and lower shaft holes to which shafts are fitted.

In this regard, it is preferred that the large gear 143 and the small gear 145 have a gear ratio of about 3:1. This ensures that the small gear 145 meshing with the large gear 143 rotates faster than the large gear 143, whereby speed reduction can be rapidly performed by the speed reducing pieces 146. In order to make the internal space of the housing smaller, the large gear 143 and the small gear 145 are preferably formed of bevel gears, worm gears or helical gears.

If an evacuee gets on the descending unit 130 positioned just below the escape hole P of the fire evacuation area of a specified story and if the descending unit 130 is moved down by the weight of the evacuee, the slowing unit 140 allows the descending unit 130 to safely descend to a lower story along the guide frames 121 and 122 at a reduced speed under the braking action of the speed reducing pieces 146.

The returning unit 150 serves to return the descended descending unit 130 to an original position. The returning unit 150 includes a weight 151 connected to the second end portion of the rope 148 drawn out from the housing of the slowing unit 140.

In this regard, the weight 151 is a typical one and is preferably heavier than the descending unit 130 so that the descended descending unit 130 can readily ascend along the guide frames 121 and 122 when the evacuee gets off the descending unit 130.

The weight 151 has a rod-like shape. The second end portion of the rope 148 is connected to the lower end portion of the weight 151. As the descending unit 130 moves up and down, the weight 151 moves along one of guide holes 116 formed in the escape hole cap 110.

The guide holes 116 are formed in a pair. The weight 151 existing in a specified story is moved through one of the guide holes 116. The weight 151 existing in a story lower than the specified story is moved through the other guide hole 116. Thus the weights 151 existing in different stories are prevented from colliding with each other during up-down movement thereof.

The returning unit 150 set forth above enables the descended descending unit 130 to quickly ascend to the original position along the guide frames 121 and 122 so that another evacuee can rapidly escape to a lower story.

The locking unit 160 serves to keep the descending unit 130 positioned in the upper portion of the guide unit 120. The locking unit 160 includes: a casing 161 arranged in the installation hole 125 formed in the upper end portion of one of the guide frames 121 and 122, the casing 161 having an opening formed on a side surface of the casing 161; a sliding body 162 retractably arranged within the casing 161, the sliding body 162 including a support lug 163 and a slant push-back portion 164, the support lug 163 obliquely formed in the sliding body 162 to extend out of the installation hole 125 through the opening of the casing 161 and configured to support a lower surface of the descending panel 131 of the descending unit 130 to thereby prevent the descending unit 130 from moving down, the slant push-back portion 164 obliquely formed at one side of the support lug 163 to extend out of the installation hole 125, the slant push-back portion 164 configured to be pushed back into the casing 161 by means of the pressing shaft 135*b* of the release button 135 so that the support lug 163 can release the descending panel 131; and a return spring 165 arranged at the rear side of the sliding body 162 to bias the sliding body 162 outward so that the support lug 163 can protrude out of the installation hole 125 to support the descending panel 131 against downward movement.

In this regard, if the release button 135 is pressed down, the support lug 163 is moved inward to thereby allow the descending unit 130 to move down along the guide unit 120. As the descending unit 130 descends from the locking unit 160, the support lug 163 of the sliding body 162 is moved outward through the installation hole 125 under the action of the return spring 165.

As the descended descending unit 130 is moved up along the guide unit 120 by means of the returning unit 150, the support lug 163 is pressed by the descending panel 131 and is moved inward, thereby permitting upward movement of the descending unit 130. As soon as the descending unit 130 ascends past the locking unit 160, the support lug 163 is moved outward of the installation hole 125 by means of the return spring 165 so as to support the descending panel 131.

With the locking unit 160 set forth above, if an evacuee gets on the descending panel 131 of the descending unit 130 and presses the release button 135, the locking unit 160 releases the descending unit 130 so that the descending unit 130 can descend along the guide frames 121 and 122. If the evacuee gets off the descending unit 130 at the end of descending movement, the descending unit 130 is moved up by the returning unit 150 and is supported again by the support lug 163. In this state, the descending unit 130 is prevented from unexpectedly moving downward. This helps prevent occurrence of a safety accident.

In the emergency escape device according to the first embodiment of the present invention, the large gear 143 of the slowing unit 140 having the pulley 142 is rotated both when the descending unit 130 descends and when the descending unit 130 ascends. A ratchet mechanism (not shown) may be provided between the large gear 143 and the pulley 142 so that only the pulley 142 can rotate when the descending unit 130 is moved up along the guide frames 121 and 122 by means of the returning unit 150. This enables the descending unit 130 to rapidly come back to the original position.

The emergency escape device according to the first embodiment of the present invention may further include a lighting unit (not shown) for lighting the fire evacuation area so that an evacuee can safely escape even in the event of electric outage. The lighting unit preferably includes a lamp arranged in the upper portion of each of the guide frames 121 and 122 and a power supply for supplying an electric current to the lamp. In this regard, the power supply may include a permanent magnet attached to the side surface of the large gear 143 or the small gear 145, a coil arranged in a coil box spaced apart from the permanent magnet and an electric wire extending from a positive terminal of the coil to the lamp. As the permanent magnet rotates together with the large gear 143 or the small gear 145, an electric current is generated in the coil and is supplied to the lamp.

In the emergency escape device according to the first embodiment of the present invention, the returning unit 150 is configured such that the descending unit 130 moved down along the guide unit 120 is returned to the original position by the weight 151 connected to the second end portion of the rope 148. Instead of the weight 151, a winder such as a spiral spring or a belt retractor may be connected to the second end portion of the rope 148 so that the rope 148 can be quickly rewound by the winder to return the descending unit 130 to the home position. In this case, one end of the rope 148 is preferably fixed to insertion body 111 of the escape hole cap 110 by way of a movable sheave so that the descending unit 130 can be moved up with a reduced force.

Next, description will be made on the operation of the emergency escape device according to the first embodiment of the present invention.

Figure 7:
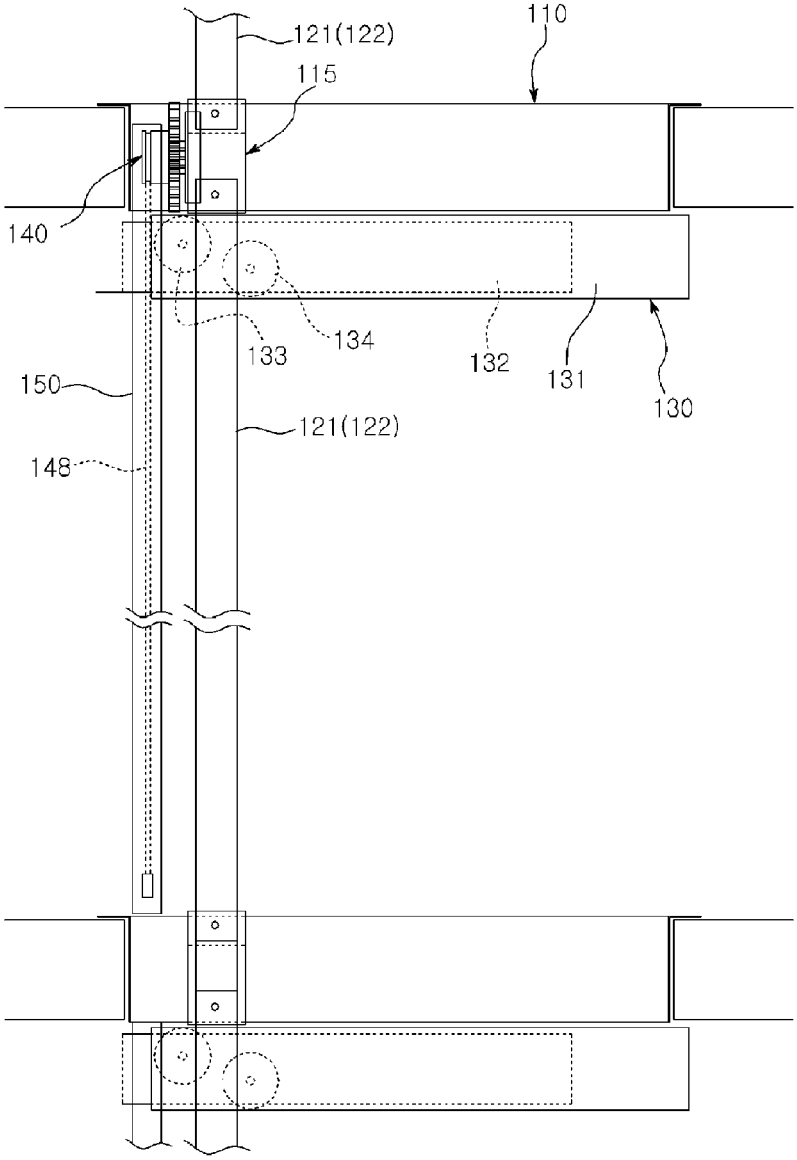
FIGS. 7 and 8 are views illustrating an emergency escape operation performed by the emergency escape device shown in FIG. 1.
Figure 8:
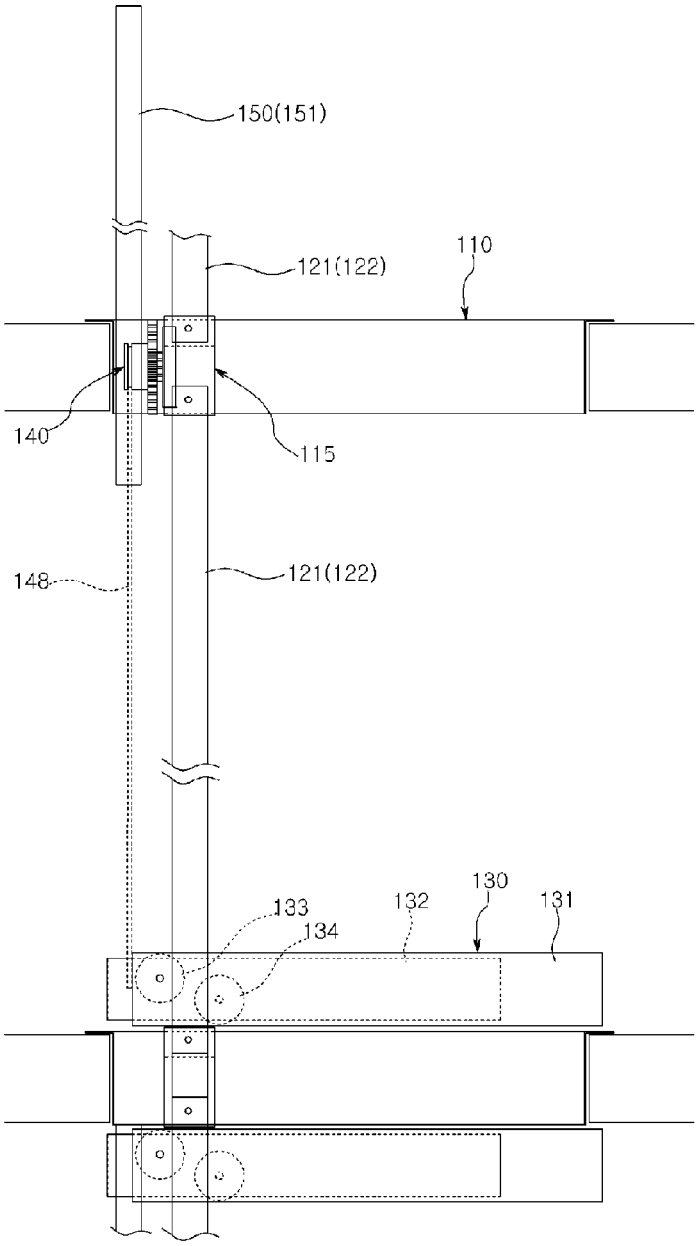

FIGS. 7 and 8 are views illustrating an emergency escape operation performed by the emergency escape device shown in FIG. 1.

As shown in FIGS. 7 and 8, the escape hole caps 110 are installed in the escape hole P of the ceiling of a specified story and in the escape hole P of the bottom of the specified story. The guide frames 121 and 122 of the guide unit 120 are fixed to the escape hole caps 110.

The slowing unit 140 is installed in the slowing unit reception compartment 114 defined inside the insertion body 111 of the escape hole cap 110. The descending panel 131 of the descending unit 130 and the weight 151 of the returning unit 150 are connected to the first and second end portions of the rope 148 of the slowing unit 140.

Prior to attaching the guide frames 121 and 122 to the escape hole cap 110, the guide frames 121 and 122 are inserted into the guide holes 131*a* of the descending panel 131 and the guide holes 132*b* of the base frame 132. The first end portion of the rope 148 is connected to the connecting portion 132*c* of the base frame 132. In this state, the unwinding length of the rope 148 connected to the weight 151 is adjusted so that the descending panel 131 can be supported by the support lug 163 of the sliding body 162 of the locking unit 160 installed in the installation hole 125 of one of the guide frames 121 and 122. Thus the descending unit 130 is kept from moving down.

In the event of an emergency situation, an evacuee moves to the fire evacuation area and gets on the descending panel 131 of the descending unit 130 positioned just below the escape hole P of a specified story.

Then, if the evacuee presses the release button 135 with his or her foot, the support lug 163 of the locking unit 160 is retracted into the casing 161 of the locking unit 160, thereby releasing the descending panel 131. As a consequence, the descending unit 130 is moved down along the guide frames 121 and 122 of the guide unit 120.

During the downward movement of the descending unit 130, the weight 151 of the returning unit 150 is moved up through the guide hole 116 formed in the escape hole cap 110. In response, the large gear 143 of the slowing unit 140 is rotated by the pulling force of the rope 148 connected to the descending panel 131 and the weight 151. As the rotating speed of the large gear 143 is increased, the speed reducing pieces 146 arranged in the speed reducing wheel 144 of the small gear 144 meshing with the large gear 143 are displaced radially outward by the centrifugal force. Thus the speed reducing pieces 146 come into contact with the inner surface of the speed reducing cover 147, thereby applying brake to the speed reducing wheel 144 so that the large gear 143 can rotate at a reduced speed. This makes it possible to keep the descending speed of the descending unit 130 substantially constant. The first and second guide rollers 133 and 134 attached to the base frame 132 of the descending unit 130 make rolling contact with the guide frames 121 and 122 during the downward movement of the descending unit 130. This ensures that the descending unit 130 is smoothly moved down along the guide frames 121 and 122 with reduced frictional resistance.

The descending unit 130 continues to descend until the descending unit 130 comes into contact with the upper surface of the escape hole cap 110 installed in the escape hole P defined in the floor surface of a lower story. In this state, the evacuee gets off the descending unit 130. If the weight of the evacuee is removed from the descending panel 131 of the descending unit 130, the descending unit 130 is moved up along the guide frames 121 and 122 under the action of the weight 151 of the returning unit 150.

At this time, the weight 151 of the returning unit 150 is moved down through the guide hole 116 of the escape hole cap 110. In response, the descending unit 130 is moved up along the guide frames 121 and 122 by the distance corresponding to the descending distance of the weight 151.

During the upward movement of the descending unit 130, the large gear 143 is held against rotation by the ratchet mechanism (not shown) provided between the pulley 142 and the large gear 143 of the slowing unit 140. Accordingly, the descending unit 130 is quickly moved up to the original position until the descending unit 130 comes into contact with the escape hole cap 110. This assists in enabling another evacuee to rapidly escape to the lower story of a building.

Once the descending unit 130 moves up to the original position and makes contact with the escape hole cap 110 of the upper story, the support lug 163 of the locking unit 160 protrudes under the descending unit 130 and supports the descending unit 130 against downward movement until and unless the release button 135 is pressed again.

Figure 9:
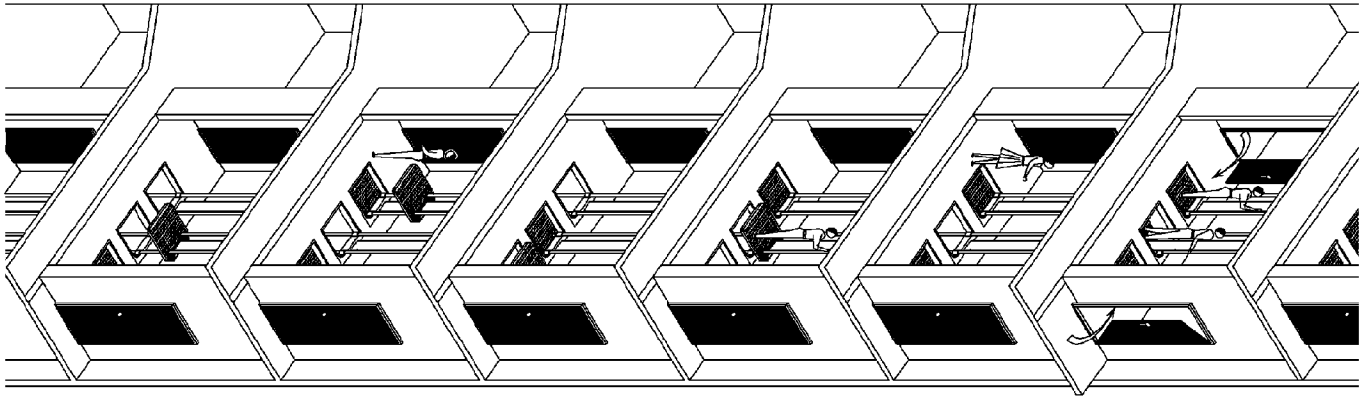
FIG. 9 is a view illustrating another example of a high-rise building to which the emergency escape device shown in FIG. 1 is applied.

FIG. 9 is a view illustrating another example of a high-rise building to which the emergency escape device shown in FIG. 1 is applied.

In the first preferred embodiment described above, only one escape hole P is formed in the fire evacuation area of each of the stories of a building. Alternatively, a plurality of escape holes P may be formed side by side in the fire evacuation area of each of the stories.

Figure 10:
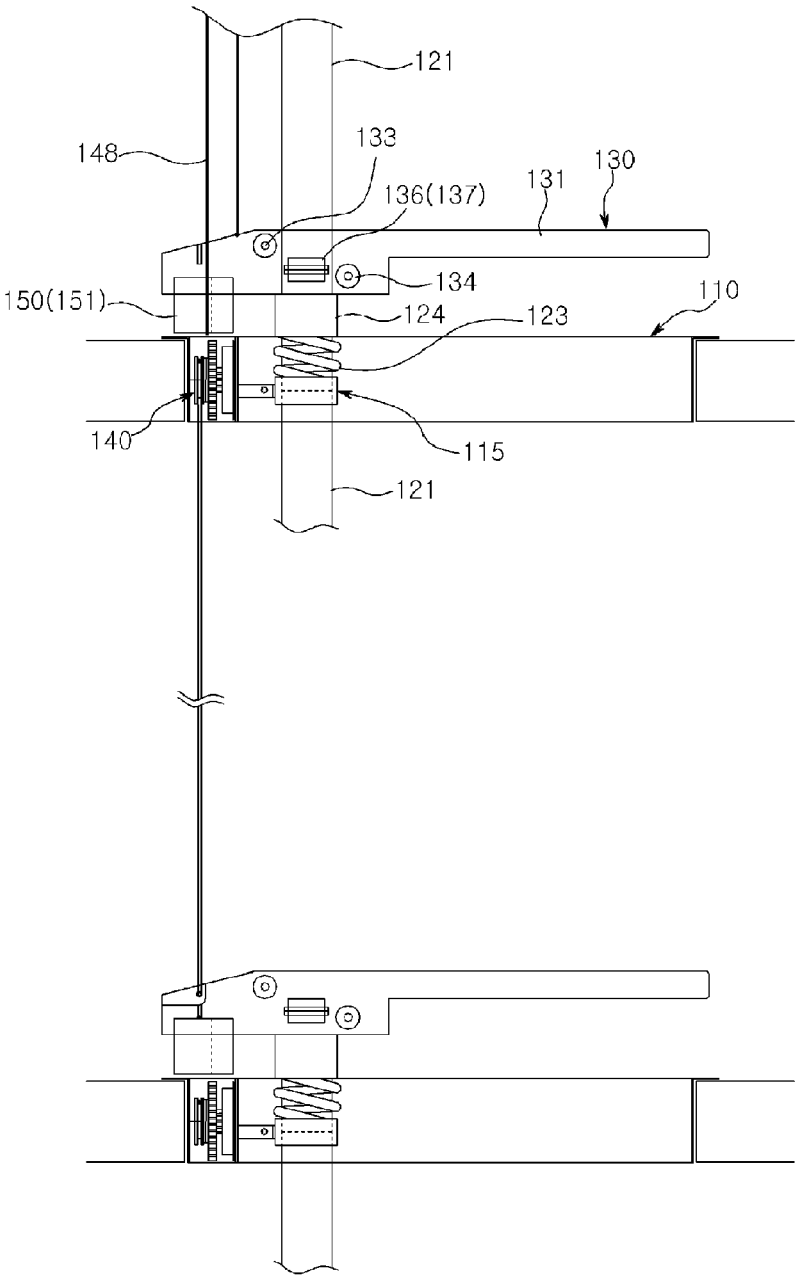
FIGS. 10 and 11 are side and top transparent section views schematically illustrating an emergency escape device according to a first modified example of the first preferred embodiment.
Figure 11:
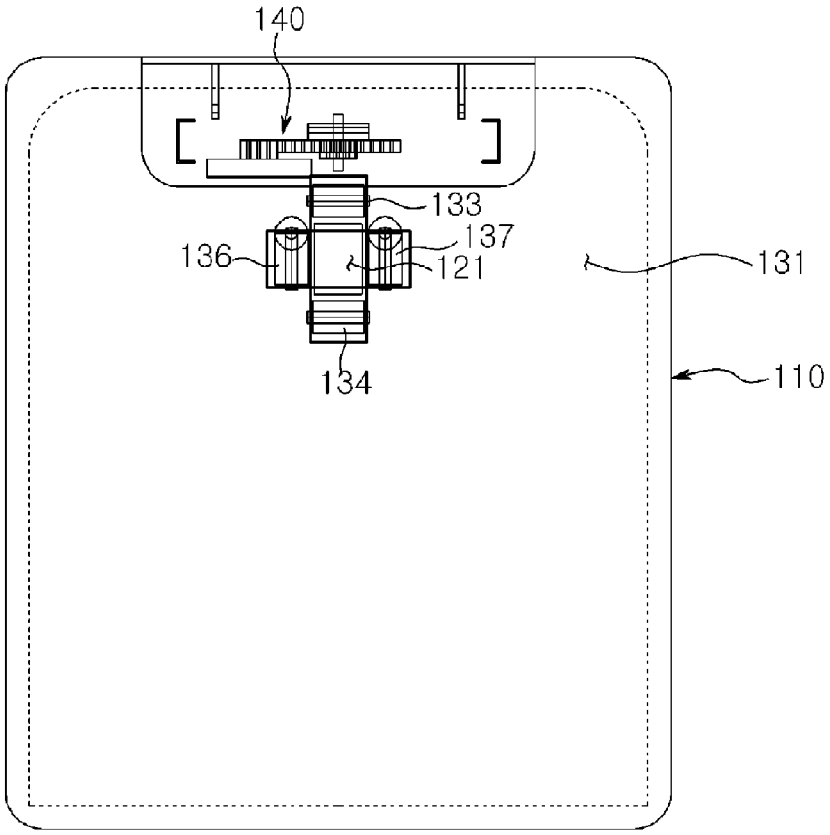

FIGS. 10 and 11 are side and top transparent section views schematically illustrating an emergency escape device according to a first modified example of the first preferred embodiment.

In the first preferred embodiment described above, the guide members 120 vertically extending from the upper and lower surfaces of the escape hole cap 110 are fixed to the support brackets 115 of the escape hole cap 110. The descending unit 130 is installed to move up and down along the guide frames 121 and 122. In the first modified example of the first preferred embodiment, as shown in FIGS. 10 and 11, a single guide frame 121 may be fixed to a single support bracket 115 provided in the escape hole cap 110. In this case, the descending unit 130 can move up and down along the single guide frame 121. Preferably, first, second, third and fourth guide rollers 133, 134, 136 and 137 are arranged at the front, rear, left and right sides of the guide frame 121 so as to make rolling contact with the guide frame 121.

The first modified example of the first preferred embodiment remains the same as the first preferred embodiment except that the guide frame 121 is single. The configurations identical with or similar to those of the first preferred embodiment will not be described in detail The weight 151 may not be a rod-like shape but may be a lump-like shape. A guide frame for guiding the weight 151 may be provided below the slowing unit reception compartment 114 to extend over an up-down movement range of the weight 151.

Figure 12:
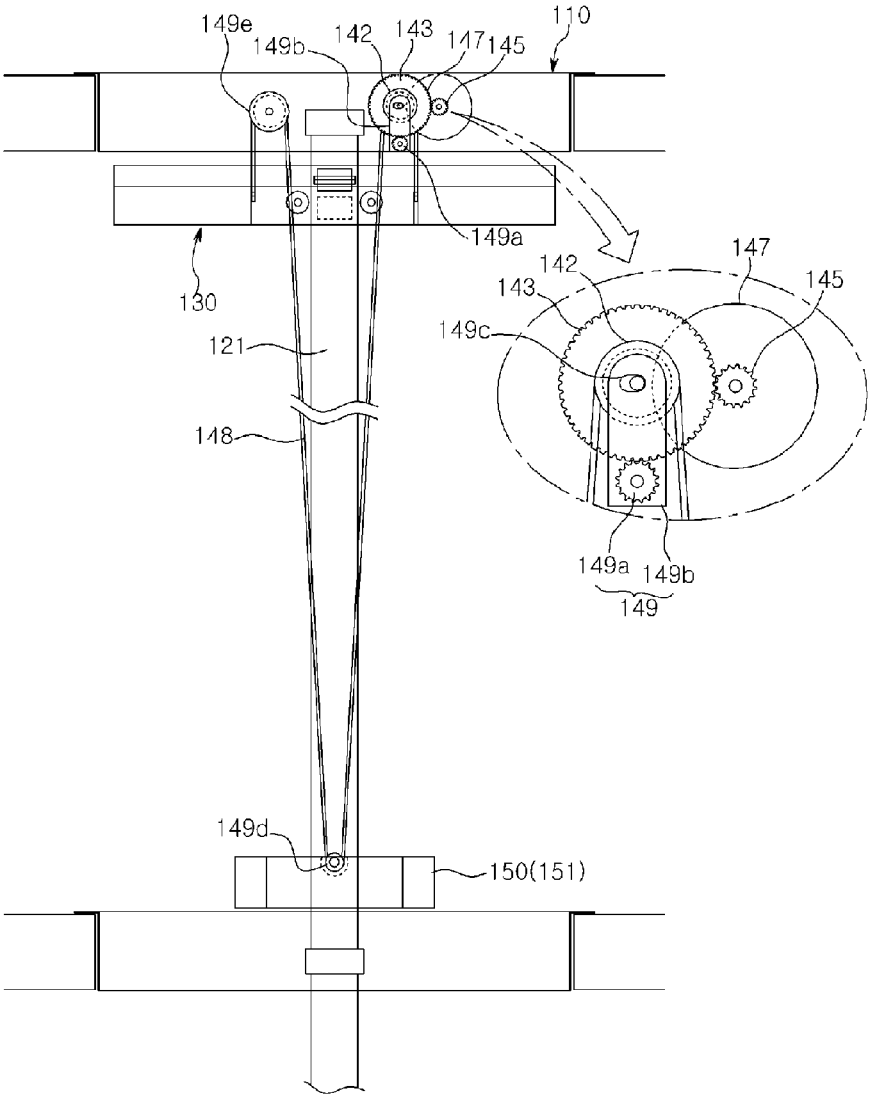
FIGS. 12 and 13 are front transparent section views schematically illustrating an emergency escape device according to a second modified example of the first preferred embodiment.
Figure 13:
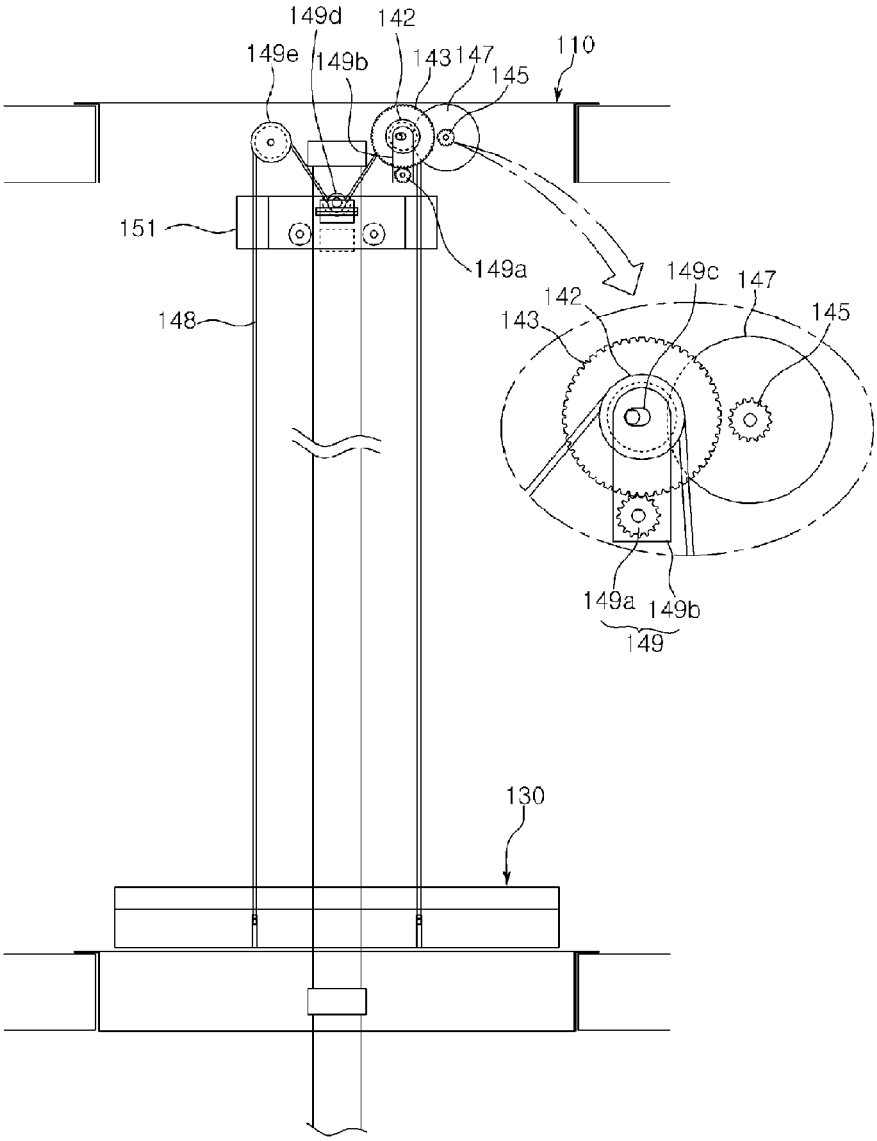

FIGS. 12 and 13 are front transparent section views schematically illustrating an emergency escape device according to a second modified example of the first preferred embodiment.

In the first preferred embodiment described above, the slowing unit 140 for allowing the descending unit 130 to descend along the guide unit 120 at a reduced speed includes the ratchet mechanism (not shown) arranged between the large gear 143 and the pulley 142. The ratchet mechanism enables the pulley 142 to rotate independently of the large gear 143 so that the descending unit 130 can be quickly moved up to the original position.

In the second modified example of the first preferred embodiment, as shown in FIGS. 12 and 13, the slowing unit 140 is not provided with any ratchet mechanism and is configured to enable the large gear 143 and the small gear 145 to mesh with each other only when the descending panel 131 is pressed by the foot of the evacuee. The slowing unit 140 further includes: a driven gear 149*a* arranged below the large gear 143 to mesh with the large gear 143; and a support piece 149*b* for interconnecting a shaft of the driven gear 149*a* and a shaft of the large gear 143 and supporting the shaft of the large gear 143, the support piece 149*b* having a slot 149*c* into which the shaft of the large gear 143 is slidably inserted so that, when the descending panel 131 is pressed, the large gear 143 can move toward the small gear 145 and can mesh with the small gear 145. The first end portion of the rope 148 is wound around the pulley 142 and fixed to a right portion of the descending panel 131. The intermediate portion of the rope 148 is wound around a sheave 149*d* attached to the weight 151. The second end portion of the rope 148 is wound around a pulley 149*e* arranged at one side of the large gear 143 and fixed to a left portion of the descending panel 131.

In this regard, it is preferred that the weight 151 has a lump-like shape rather than a rod-like shape. The weight 151 is held by the intermediate portion of the rope 148 through the sheave 149*d* in such a way that the weight 151 is positioned near the lower end portion of the guide unit 120 when the descending unit 130 is supported by the support lug 163 of the locking unit 160 in the upper end portion of the guide unit 120 but the weight 151 is positioned near the upper end portion of the guide unit 120 when the descending unit 130 is moved down to the lower end portion of the guide unit 120.

With the slowing unit 140 described above, if the evacuee gets on the descending panel 131 and presses the descending unit 130 with the foot of the evacuee in a state that the large gear 143 and the small gear 145 are spaced apart from each other, the rope 148 applies a rotating force to the large gear 143 in such a direction as to move the large gear 143 toward the small gear 145. As a result, the shaft of the large gear 143 is moved toward the small gear 145 along the slot 149*c* of the support piece 149*b* so that the large gear 143 can mesh with the small gear 145. Consequently, the small gear 145 provided with a speed reducing unit is rotated by the large gear 143, thereby ensuring that the descending unit 130 descends along the guide unit 120 at a reduced speed. This makes it possible for the evacuee to safely escape to the lower story.

If the evacuee gets off the descending unit 130 and sets the descending unit 130 free in a state that the large gear 143 meshes with the small gear 145, the rope 148 applies a rotating force to the large gear 143 in such a direction as to move the large gear 143 away from the small gear 145. As a result, the shaft of the large gear 143 is moved toward the pulley 149*e* along the slot 149*c* of the support piece 149*b* so that the large gear 143 can disengage from the small gear 145. Consequently, the small gear 145 provided with a speed reducing unit is not rotated. This enables the descending unit 130 to quickly ascend to the original position with no reduction in speed.

With the emergency escape device of the present invention described above, it is possible to enable safe and rapid escape of evacuees by ensuring that the descending unit installed in the escape hole of the fire evacuation area descends at a reduced speed along the guide unit vertically installed in the escape hole when an emergency evacuation situation such as fire or the like occurs in a high-rise building.

Moreover, the emergency escape device of the present invention enables evacuees to successively and rapidly escape from a building by ensuring that the descending unit moved down along the guide unit can quickly come back to the original position.

Inasmuch as the emergency escape device is permanently installed in the fire evacuation area of a building, it is possible for evacuees to rapidly and safely escape from the building in the event of an emergency situation without having to bring a separate emergency escape device to the fire evacuation area.

In the emergency escape device of the first preferred embodiment described above, the weight is employed as the returning unit for returning the descending unit moved down along the guide unit to the original position. Alternatively, the emergency escape devices according to second and third preferred embodiments of the present invention employ a spiral spring type winder as the returning unit for returning the descending unit moved down along the guide unit to the original position. This makes it possible to reduce the manufacturing cost of the emergency escape device and to restrain generation of noises during the operation of the emergency escape device.

Description will now be made on the emergency escape devices according to second and third preferred embodiments of the present invention.

Figure 14:
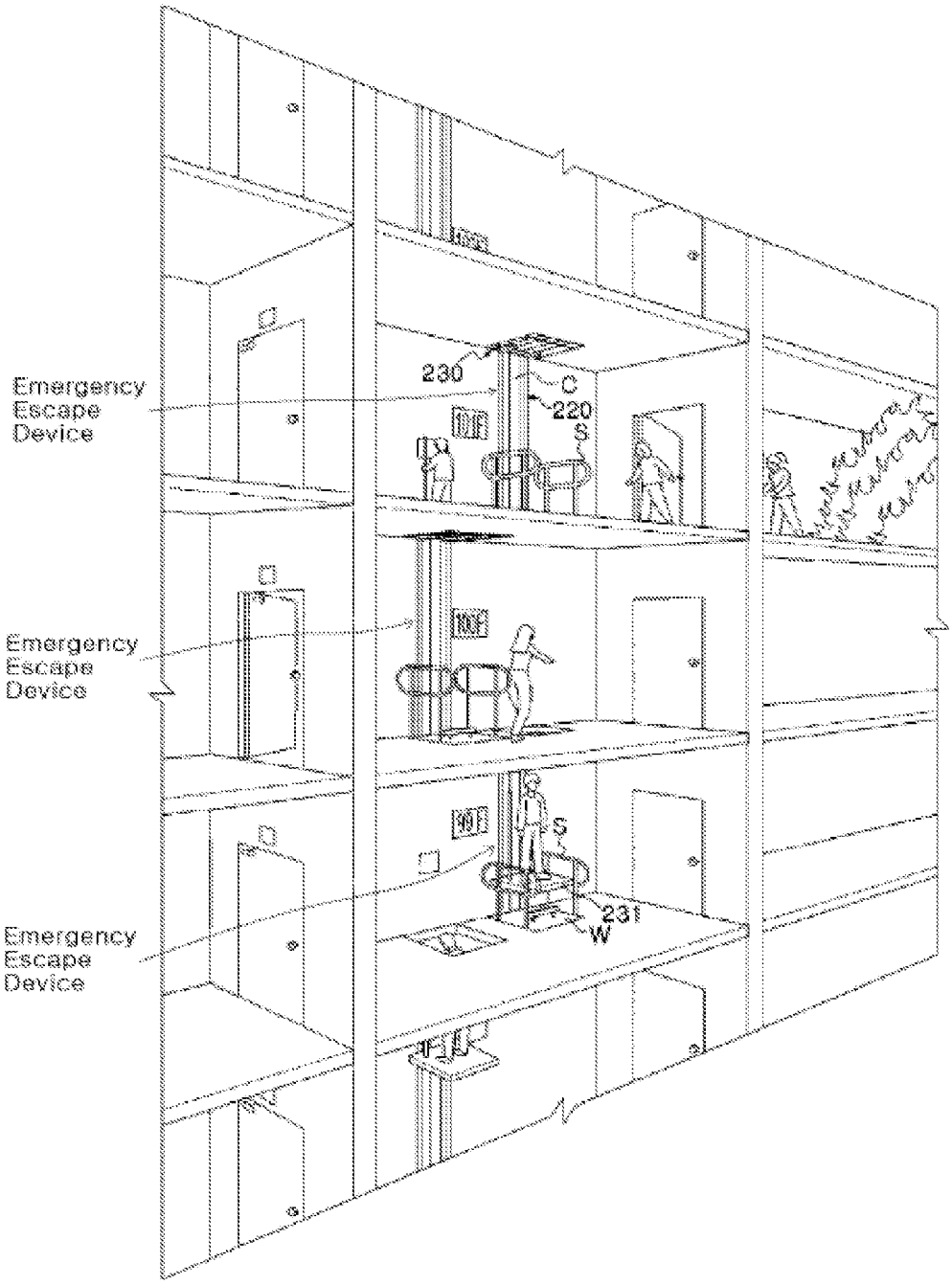
FIG. 14 is a view showing an emergency escape area to which an emergency escape device according to a second preferred embodiment of the present invention is applied.
Figure 15:
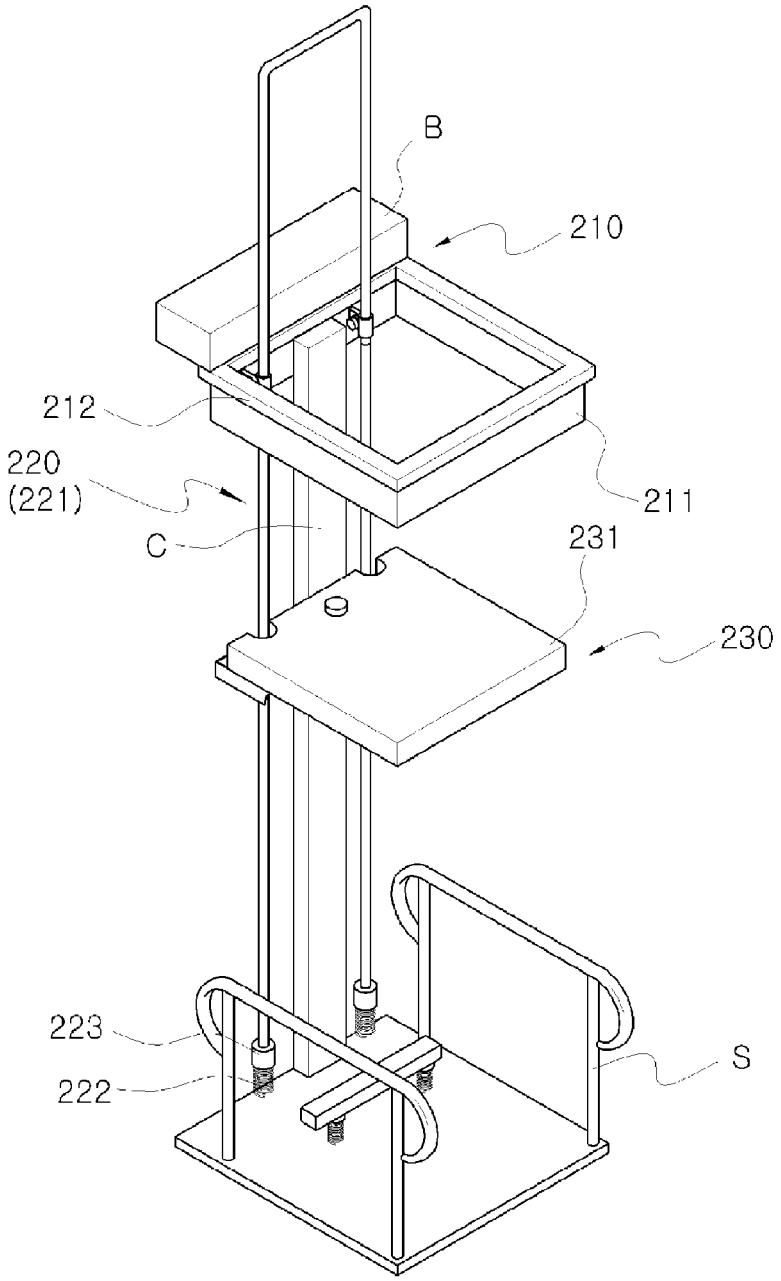
FIG. 15 is a perspective view of the emergency escape device shown in FIG. 14.
Figure 16:
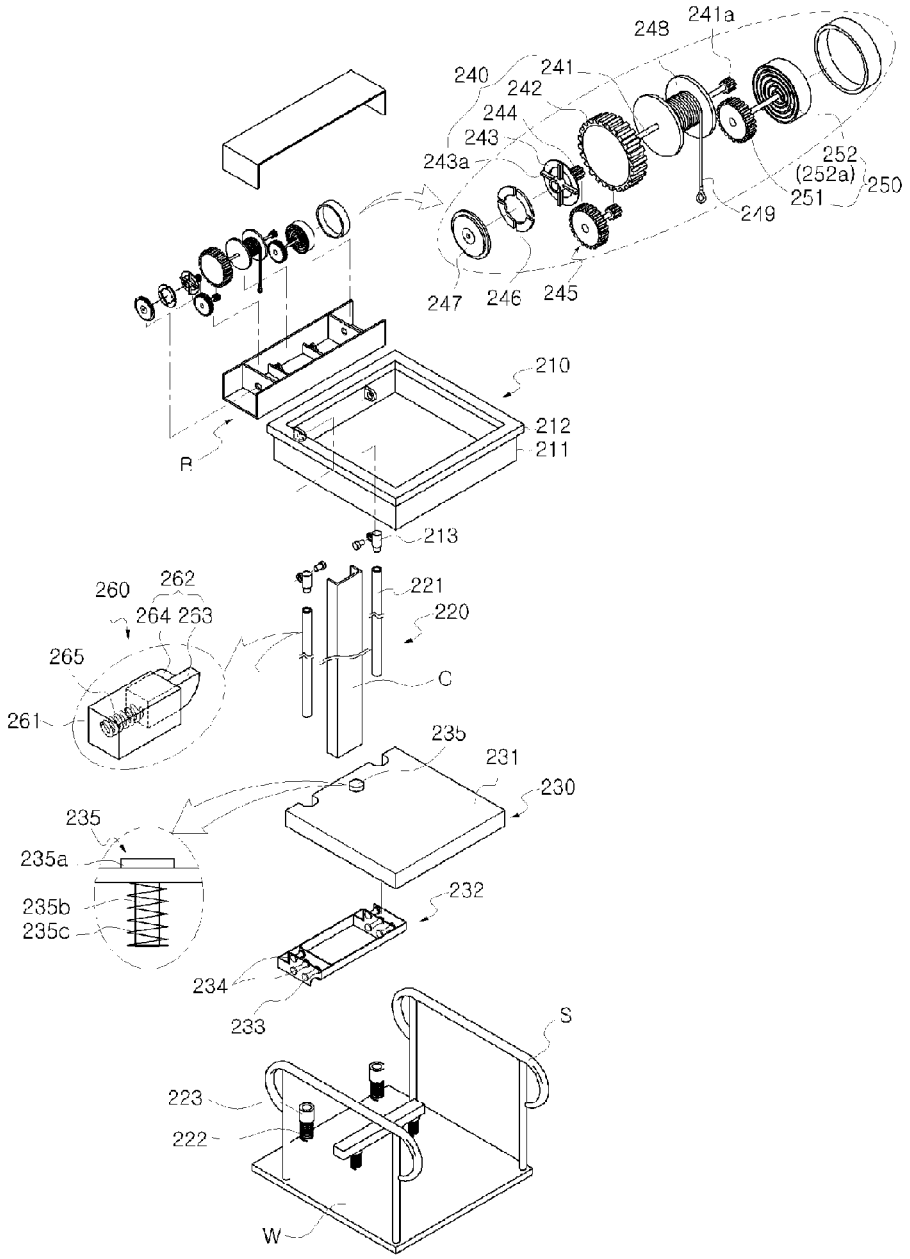
FIG. 16 is an exploded perspective view of the emergency escape device shown in FIG. 15.
Figure 17:
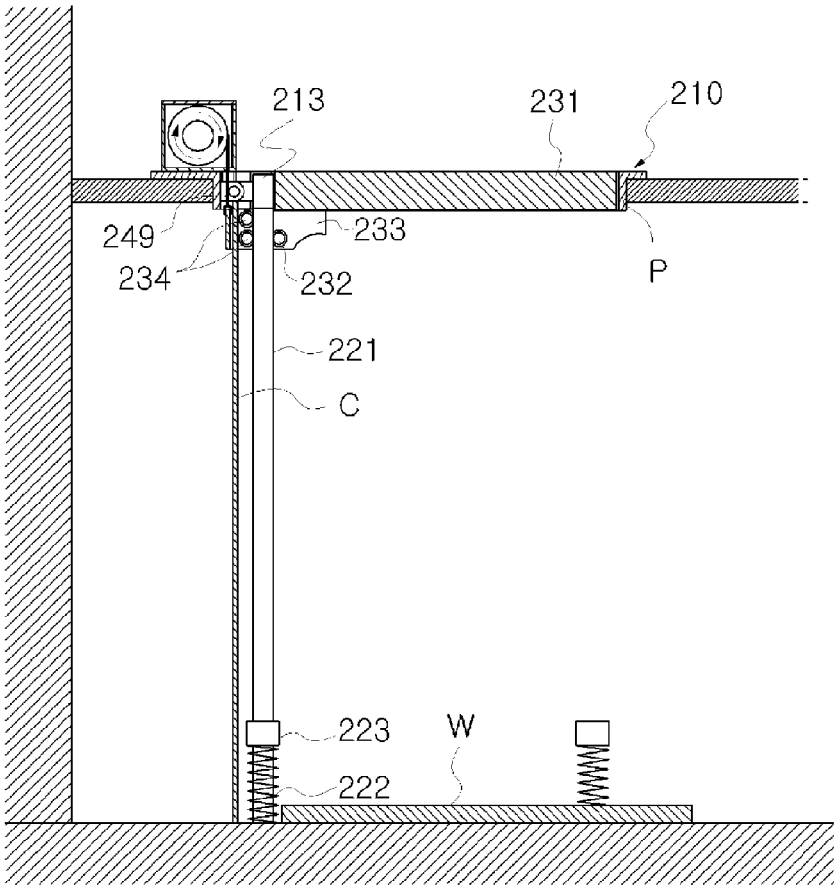
FIG. 17 is a side section view of the emergency escape device shown in FIG. 15.

FIG. 14 is a view showing an emergency escape area to which the emergency escape device according to the second preferred embodiment of the present invention is applied. FIG. 15 is a perspective view of the emergency escape device shown in FIG. 14. FIG. 16 is an exploded perspective view of the emergency escape device shown in FIG. 15. FIG. 17 is a side section view of the emergency escape device shown in FIG. 15.

As shown in FIGS. 14 through 17, the emergency escape device according to the second preferred embodiment of the present invention includes: an escape hole cap 210 fitted from above to an escape hole P of a fire evacuation area of a high-rise building so as to cover an inner edge of the escape hole P; a guide unit 220 vertically installed below the escape hole cap 210; a descending unit 230 positioned below the escape hole cap 210 and slidably attached to the guide unit 220 in such a manner as to descend along the guide unit 220 when an evacuee gets on the descending unit 230; a slowing unit 240 configured to ensure that the descending unit 230 descends along the guide unit 220 at a reduced speed; a returning unit 250 for returning the descending unit 230 descended along the guide unit 220 to an original position; and a locking unit 260 for keeping the descending unit 230 against downward movement in an upper portion of the guide unit 220.

In this regard, the fire evacuation area is a safe evacuation area provided in, e.g., an inter-household balcony border of an apartment. The fire evacuation area has an escape hole P through which an upper story and a lower story communicate with each other so that an evacuee can escape from the upper story to the lower story through the escape hole P using the emergency escape device.

The escape hole cap 210 is fitted from above to the escape hole P formed in the floor surface of the fire evacuation area so as to cover an inner edge of the escape hole P. The escape hole cap 210 includes: an insertion body 211 having a length substantially equal to the thickness of a floor in which the escape hole P is formed; a flange 212 formed to protrude from an upper end of the insertion body 211 and supported by the floor surface around the escape hole P when the insertion body 211 is inserted into the escape hole P; a shock absorber (not shown) arranged on a lower surface of the flange 212 to absorb shocks applied to the escape hole cap 210; and a support bracket 213 attached to a side surface of the insertion body 211 and configured to vertically support the guide unit 220 positioned below the escape hole P.

In case where an upper story and a lower story communicate with each other through the escape hole P, the guide units 220 may be vertically installed above and below the escape hole cap 210. In this case, the guide units 220 are connected to upper and lower end portions of the support bracket 213.

With the escape hole cap 110 set forth above, the insertion body 211 is inserted from above to the escape hole P formed on the floor surface of a specific story. This helps prevent the body of an evacuee from being scratched by the edge of the escape hole P when the evacuee escapes through the use of the descending unit 230. The shock absorber (not shown) of the escape hole cap 210 absorbs shocks applied to the escape hole cap 210 when another descending unit 230 descends from the upper story and makes contact with the escape hole cap 210. This makes it possible to prevent occurrence of a safety accident.

The guide unit 220 is vertically installed below the escape hole cap 210 (in case where the escape holes P of two upper and lower stories are formed out of alignment) or above and below the escape hole cap 210 (in case where the escape holes P of two upper and lower stories are aligned with each other) so that the descending unit 230 can safely descend and ascend along the guide unit 220. The guide unit 220 includes a pair of guide frames 221 attached to the upper and lower portions of the support bracket 213. Each of the guide frames 221 has a length substantially equal to the height of the fire evacuation area.

In case where the escape holes P of two upper and lower stories are aligned with each other, a shock absorbing spring 222 and a sleeve 223 are fitted to the upper end portion of the support bracket 213 prior to fitting each of the guide frames 221 to the upper end portion of the support bracket 213. The shock absorbing spring 222 serves to absorb shocks applied to the descending unit 230 that descends along each of the guide frames 221. The sleeve 223 is fixed to the upper end of the shock absorbing spring 222 and is configured to receive the lower end portion of each of the guide frames 221. In case where the escape holes P of two upper and lower stories are formed out of alignment, a shock absorbing spring 222 and a sleeve 223 are fitted to the lower end portion of the guide unit 220.

Each of the guide frames 221 has a length substantially equal to the distance between the escape hole caps 210 installed in the upper and lower stories of a building, i.e., the height of a specific story of the building. When the descending unit 130 descends toward the floor surface of the lower story, an evacuee can grip each of the guide frames 221. This enables the evacuee to escape safely. An installation hole (not shown) is formed in the upper end portion of one of the guide frames 221. The locking unit 260 for releasably locking the descending unit 230 is arranged in the installation hole. Each of the guide frames 221 may be directly fixed to the escape hole cap 210 by welding or other fixing methods.

While the guide frames 221 are provided in a pair in the illustrated example, it may be possible to a single guide frame. A decoration panel C is arranged between the guide frames 221. The decoration panel C can provide a moving path of a chain 249 and a balancing weight (not shown) of the slowing unit 240 and can improve the external appearance of the emergency escape device. A single guide frame may be installed to extend along the decoration panel C.

With the guide unit 220 set forth above, the guide frames 221 are fitted to the upper and lower end portions of the support bracket 213 of the escape hole cap 210. The escape hole cap 210 is supported on the floor surface or the ceiling surface around the escape hole P. This makes it possible to keep the guide frames 221 stable when an evacuee escapes using the descending unit 230. The guide frames 221 can be easily installed by merely fitting the guide frames 221 to the upper and lower end portions of the support bracket 213.

The descending unit 230 is mounted to the guide unit 220 at the lower side of the insertion body 211 of the escape hole cap 210. The descending unit 230 is configured to descend along the guide unit 220. The descending unit 230 includes: a descending panel 231 having a pair of cutouts corresponding in shape to the guide frames 221 of the guide unit 220; a base frame 232 including a pair of embedment portions embedded in the descending panel 231, the base frame 232 having guide holes formed in the embedment portions in alignment with the cutouts of the descending panel 231, the guide frames 221 fitted to the guide holes of the base frame 232, the base frame 232 further including a connecting portion connected to a first end portion of a chain 249 of the slowing unit 240; first and second guide rollers 233 and 234 rotatably attached to the embedment portions so as to make rolling contact with the guide frames 221 inserted into the guide holes of the base frame 232; and a release button 235 provided in the descending panel 231 so as to release the locking unit 260 for having the descending panel 231 locked in an upper portion of one of the guide frames 221.

Preferably, the descending panel 231 is formed of a durable light panel having a specified thickness and an area substantially equal to the area of the escape hole P. Although not shown in the drawings, it is preferred that a safety bar to be gripped by an evacuee is installed on the upper surface of the descending panel 231.

The first and second guide rollers 233 and 234 making rolling contact with the guide frames 221 are formed into a well-known shape and configuration so that the friction between the first and second guide rollers 233 and 234 and the guide frames 221 can be minimized. The first and second guide rollers 233 and 234 are preferably kept spaced apart from the guide frames 221 by a specified distance so that the first and second guide rollers 233 and 234 make rolling contact with the guide frames 221 only when the descending panel 231 is tilted. This helps reduce friction and noises.

The release button 235 includes: a head 235*a* that can be pressed by the foot of an evacuee who gets on the descending panel 231 to escape to a lower story in the event of an emergency situation; a pressing shaft 235*b* extending from the head 235*a* to vertically penetrate the descending panel 231, the pressing shaft 235*b* configured to, when the head 235*a* is pressed, move down and press a slant push-back portion 264 of the locking unit 260 so that a sliding body 262 of the locking unit 260 can be retracted into an installation hole of one of the guide frames 221; and a biasing spring 235*c* arranged within the descending panel 231 to surround the pressing shaft 235*b*, the biasing spring 235*c* configured to bias the pressing shaft 235*b* upward. In this regard, an entrance hole through which the sliding body 262 of the locking unit 260 can move is formed the side wall of the descending panel 231 near the release button 235.

In case where the decoration panel C is installed between the guide frames 221, an installation hole may be formed in the decoration panel C. In this case, the release button 235 is arranged in a through-hole formed in the descending panel 231 in alignment with the installation hole of the decoration panel C. The locking unit 260 is installed in the installation hole of the decoration panel C.

In the event that the escape holes P of two upper and lower stories are formed out of alignment, a platform W having guard bars S is preferably arranged on the floor surface of the lower story so that the evacuee can safely get off the descending unit 230 moved down.

With the descending unit 230 configured as above, the descending panel 231 can descend along the guide frames 221 installed in the fire evacuation area of a high-rise building, whereby an evacuee can safely escape from an upper story to a lower story with no likelihood of collision with a building wall or the like.

The slowing unit 240 serves to ensure that the descending unit 230 descends along the guide unit 220 at a reduced speed. The slowing unit 240 includes: a module box B arranged on the flange 212 of the escape hole cap 210; a driving shaft 241 arranged within the module box B; a large gear 242 installed within the module box B and fixed to the driving shaft 241; a small gear 244 installed within the module box B and driven by the large gear 242, the small gear 244 provided with a speed reducing wheel 243; an intermediate gear group 245 arranged between the large gear 242 and the small gear 244 to transfer rotation of the large gear 242 to the a small gear 244 at an increased gear ratio; a plurality of speed reducing pieces 246 radially arranged in the speed reducing wheel 243 to receive centrifugal forces; a speed reducing cover 247 fixed to the module box B and arranged to surround the speed reducing wheel 243 and the speed reducing pieces 246; a pulley 248 fixed to the driving shaft 241 to rotate together with the driving shaft 241; and a chain 249 wound around the pulley 248, the chain 249 having a first end portion drawn out from a lower portion of the module box B and fixed to the connecting portion of the base frame 232 of the descending unit 230 and a second end portion fixed to the pulley 248.

In this regard, the module box B may be provided at one side of the flange 212 of the escape hole cap 210. In this case, the escape hole cap 210 has a through-hole through which the first end portion of the chain 249 to be fixed to the descending panel 231 of the descending unit 230 is drawn out.

The chain 249 may not be merely wound around the pulley 248 of the slowing unit 240 but may mesh with a sprocket formed in the pulley 248. In this case, it is preferred that a balancing weight (not shown) be connected to the second end portion of the chain 249 opposite to the first end portion fixed to the descending panel 231.

The large gear 242 is securely fixed to the driving shaft 241 and is rotationally driven by the driving shaft 241 which in turn is rotated by the pulley 248 or the returning unit 250 during emergency evacuation.

The small gear 244 is rotatably installed within the module box B so as to mesh with the large gear 242 through the gear group 245 and is rotated by the large gear 242. The small gear 244 is provided with the speed reducing wheel 243 for applying brake to the large gear 242. The speed reducing wheel 243 has a plurality of radially-extending partition ribs 243*a* for isolating the speed reducing pieces 246 from one another.

The speed reducing pieces 246 are radially arranged between the partition ribs 243*a* of the speed reducing wheel 243 to receive centrifugal forces. The speed reducing pieces 246 plays the role of a brake device when the descending unit 230 is moved down. During rotation of the speed reducing wheel 243, the speed reducing pieces 246 are pushed radially outward by centrifugal forces to make frictional contact with the inner surface of the speed reducing cover 247, thereby applying brake to the speed reducing wheel 243.

The speed reducing cover 247 is arranged to surround the speed reducing wheel 243 and the speed reducing pieces 246. The speed reducing cover 147 has central and lower shaft holes to which shafts are fitted.

The gear group 245 includes a plurality of gears arranged between the large gear 242 and the small gear 244 to change the gear ratio between the large gear 242 and the small gear 244 to, e.g., about 3:1. This ensures that the small gear 243 meshing with the large gear 242 rotates faster than the large gear 242, whereby speed reduction can be rapidly performed by the speed reducing pieces 246.

If an evacuee gets on the descending unit 230 positioned just below the escape hole P of the fire evacuation area of a specified story and if the descending unit 230 is moved down by the weight of the evacuee, the slowing unit 240 allows the descending unit 230 to safely descend to a lower story along the guide frames 221 at a reduced speed under the braking action of the speed reducing pieces 246.

It is apparent that the slowing unit 240 may be formed of a well-known centrifugal brake or a magnetic brake instead of the components stated above.

The returning unit 250 serves to return the descended descending unit 230 to an original position. The returning unit 250 includes: a driving gear 241*a* fixed to one end of the driving shaft 241; a driven gear 251 meshing with the driving gear 241*a* and having a rotating shaft 253; a winder 252 having a spiral spring 252*a* connected to the driven gear 251, the spiral spring 252*a* configured to be tightened as the driven gear 251 rotates in a first direction or to be loosened to rotate the driven gear 251 in a second direction.

The spiral spring 252*a* of the winder 252 has a first end portion connected to a casing of the winder 252 and a second end portion connected to the rotating shaft 253 of the driven gear 251. The spiral spring 252*a* is completely loosened when the descending unit 230 is in a ready-to-descend uppermost position. The spiral spring 252*a* is gradually tightened as the descending unit 230 is moved down. The spiral spring 252*a* is completely tightened when the descending unit 230 is in a ready-to-ascend lowermost position. The spiral spring 252*a* is gradually loosened as the descending unit 230 is moved up. In other words, the spiral spring 252*a* is forcibly tightened as the descending unit 230 is moved down. The spiral spring 252*a* is self-loosened to lift up the descending unit 230 when an evacuee gets off the descending unit 230.

The gear ratio between the driven gear 251 and the driving gear 241*a* is set substantially equal to or larger than 10:1. This ensures that the spiral spring 252*a* is slowly tightened when the rotating shaft 253 of the driven gear 251 connected to the spiral spring 252*a* is rotated by the driving shaft 241. This also ensures that the spiral spring 252*a* is slowly loosened when the driving shaft 241 is rotated by the rotating shaft 253 of the driven gear 251. It is therefore possible to reduce the volume of the spiral spring 252*a* and the winder 252.

In this regard, the spiral spring 252*a* of the winder 252 has a restoring force a little larger than the weight of the descending unit 230. This ensures that the spiral spring 252*a* is rapidly loosened when an evacuee gets on the descending unit 230 and the spiral spring 252*a* is rapidly tightened when the evacuee gets off the descending unit 230.

With the returning unit 250 set forth above, the descending unit 230 moved down along the guide frames 221 can quickly ascend to the original position. This enables another evacuee to rapidly escape from an upper story to a lower story.

Since the winder 252 having the spiral spring 252*a* is used to return the descended descending unit 230 to the original position, it is possible to provide the returning unit 250 in a cost-effective manner without having to use an expensive weight. It is also possible to suppress generation of frictional noises.

The locking unit 260 serves to keep the descending unit 230 positioned in the upper portion of the guide unit 220. The locking unit 260 includes: a casing 261 arranged in the installation hole formed in the upper end portion of one of the guide frames 221, the casing 261 having an opening formed on a side surface of the casing 261; a sliding body 262 retractably arranged within the casing 261, the sliding body 262 including a support lug 263 and a slant push-back portion 264, the support lug 263 obliquely formed in the sliding body 262 to extend out of the installation hole through the opening of the casing 261 and configured to support a lower surface of the descending panel 231 of the descending unit 230 to thereby prevent the descending unit 230 from moving down, the slant push-back portion 264 obliquely formed at one side of the support lug 263 to extend out of the installation hole, the slant push-back portion 264 configured to be pushed back into the casing 261 by means of the pressing shaft 235*b* of the release button 235 so that the support lug 263 can release the descending panel 231; and a return spring 265 arranged at the rear side of the sliding body 262 to bias the sliding body 262 outward so that the support lug 263 can protrude out of the installation hole to support the descending panel 231 against downward movement.

In this regard, if the release button 235 is pressed down, the support lug 263 is moved inward to thereby allow the descending unit 230 to stably move down along the guide unit 220. As the descending unit 230 descends from the locking unit 260, the support lug 263 of the sliding body 262 is moved outward through the installation hole under the action of the return spring 265.

As the descended descending unit 230 is moved up along the guide unit 220 by means of the returning unit 250, the support lug 263 is pressed by the descending panel 231 and is moved inward, thereby permitting upward movement of the descending unit 230. As soon as the descending unit 230 ascends past the locking unit 260, the support lug 263 is moved outward of the installation hole by means of the return spring 265 so as to support the descending panel 231.

In case where the decoration panel C is installed between the guide frames 221, an installation hole may be formed in the decoration panel C. In this case, the release button 235 is arranged in a through-hole formed in the descending panel 231 in alignment with the installation hole of the decoration panel C. The locking unit 260 is installed in the installation hole of the decoration panel C.

With the locking unit 260 set forth above, if an evacuee gets on the descending panel 231 of the descending unit 230 and presses the release button 235, the locking unit 260 releases the descending unit 230 so that the descending unit 230 can descend along the guide frames 221. If the evacuee gets off the descending unit 230 at the end of descending movement, the descending unit 230 is moved up by the returning unit 250 and is supported again by the support lug 263. In this state, the descending unit 230 is prevented from unexpectedly moving downward. This helps prevent occurrence of a safety accident.

In the emergency escape device according to the second embodiment of the present invention, the large gear 243 of the slowing unit 240 is rotated both when the descending unit 230 descends and when the descending unit 230 ascends. A ratchet mechanism (not shown) may be provided in the large gear 243 so that the descending unit 230 can rapidly come back to the original position.

Next, description will be made on the operation of the emergency escape device according to the second embodiment of the present invention.

Figure 18:
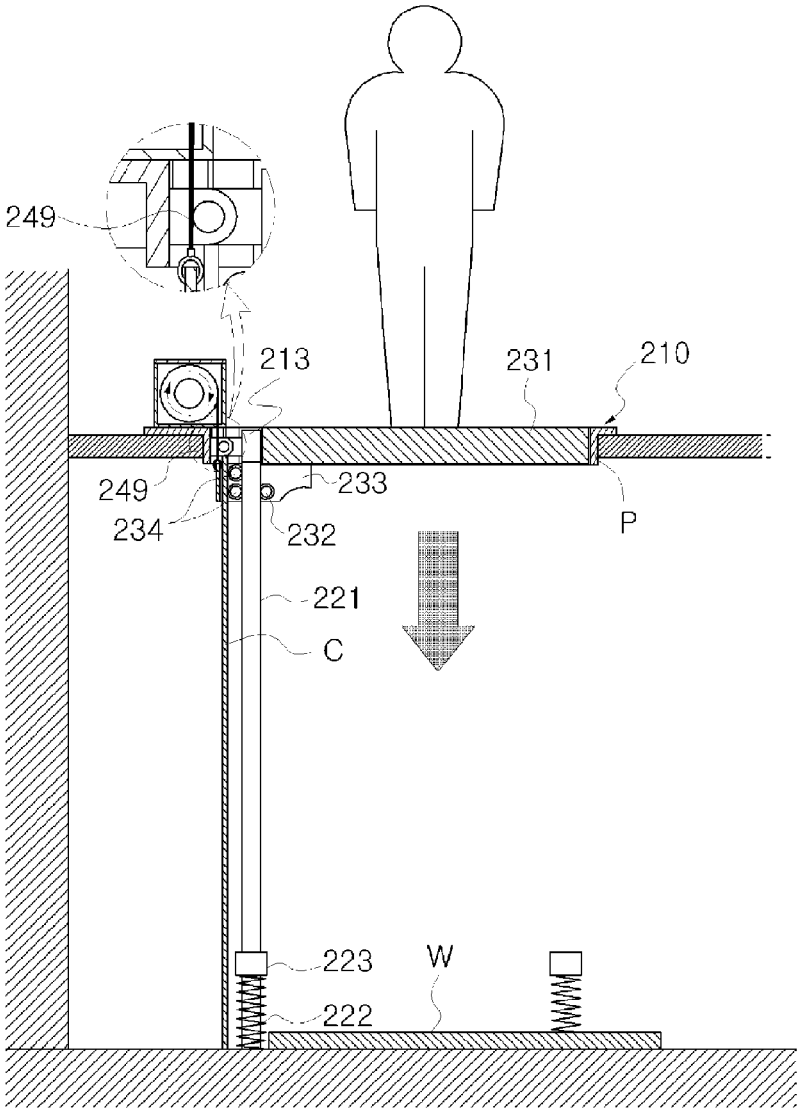
FIGS. 18 and 19 are views illustrating an emergency escape operation performed by the emergency escape device shown in FIG. 15.
Figure 19:
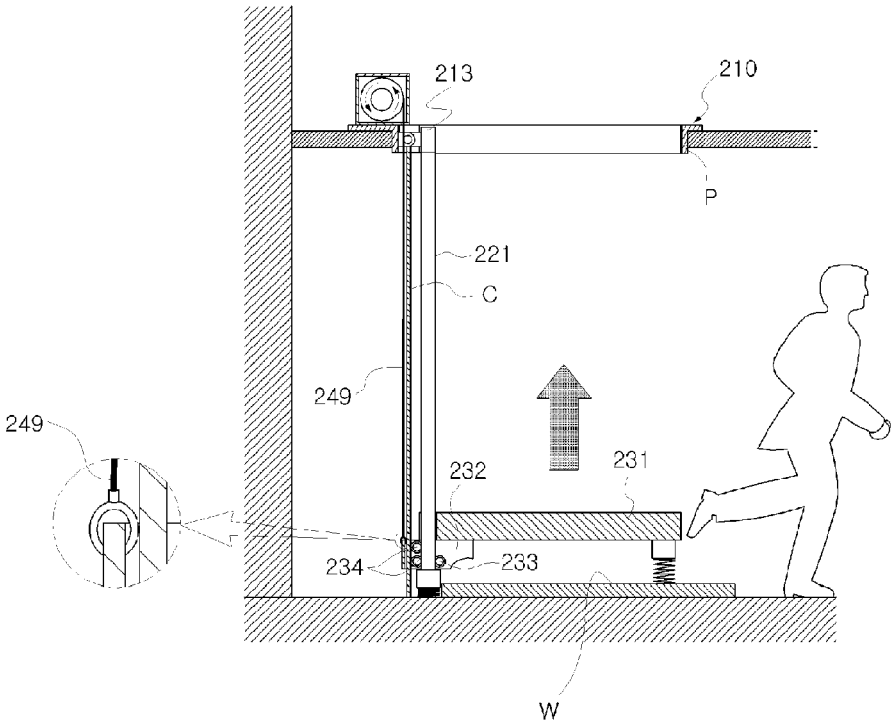

FIGS. 18 and 19 are views illustrating an emergency escape operation performed by the emergency escape device shown in FIG. 15.

As shown in FIGS. 18 and 19, the escape hole cap 210 is installed in the escape hole P formed on the floor surface of a specified story. Then, the guide frames 221 of the guide unit 220 are fixed to the insertion body 211 of the escape hole cap 210. Thereafter, the slowing unit 240 and the returning unit 250 are installed in the module box B arranged at one side of the escape hole cap 210. The descending panel 231 of the descending unit 230 is connected to the chain 249 of the slowing unit 240.

Prior to attaching the guide frames 221 to the escape hole cap 210, the guide frames 221 are inserted into the guide holes 232*b* of the base frame 232. The first end portion of the chain 249 is connected to the connecting portion 232*c* of the base frame 232. In this state, the unwinding length of the chain 249 is adjusted so that the descending panel 231 can be supported by the support lug 263 of the sliding body 262 of the locking unit 260 installed in the installation hole of one of the guide frames 221. Thus the descending unit 230 is kept from moving down.

In the event of an emergency situation such as fire or the like, an evacuee moves to the fire evacuation area and gets on the descending panel 231 of the descending unit 230 positioned just below the escape hole P of a specified story.

Then, if the evacuee presses the release button 235 with his or her foot, the support lug 263 of the locking unit 260 is retracted into the casing of the locking unit 260, thereby releasing the descending panel 231. As a consequence, the descending unit 230 is moved down along the guide frames 221 of the guide unit 220.

At this time, the driving shaft 241 connected to the descending panel 231 through the chain 249 is rotated in one direction so that the spiral spring 252*a* of the winder 252 of the returning unit 250 can be gradually tightened. The large gear 242 is also rotated as the descending unit 230 is moved down.

As the rotating speed of the large gear 242 is increased, the speed reducing pieces 246 arranged in the speed reducing wheel 243 of the small gear 244 meshing with the large gear 242 are displaced radially outward by the centrifugal force. Thus the speed reducing pieces 246 come into contact with the inner surface of the speed reducing cover 247, thereby applying brake to the speed reducing wheel 243 so that the driving shaft 241 and the pulley 248 can rotate at a reduced speed. This makes it possible to keep the descending speed of the descending unit 230 substantially constant.

The first and second guide rollers 233 and 234 rotatably attached to the base frame 232 of the descending unit 230 make rolling contact with the guide frames 221 during the downward movement of the descending unit 230. This ensures that the descending unit 230 is smoothly moved down along the guide frames 221 with reduced frictional resistance.

If the evacuee gets off the descending unit 230 after the descending unit 230 is moved down to the platform W arranged on the floor surface of a lower story, the weight of the evacuee is removed from the descending unit 230. Thus the descending unit 230 is moved up along the guide frames 221 under the action of the returning unit 250.

At this time, the driving shaft 241 is rotated in the opposite direction so that the spiral spring 252*a* of the winder 252 of the returning unit 250 can be gradually loosened. Consequently, the descending unit 230 connected to the driving shaft 241 through the chain 249 is moved up by the restoring force of the spiral spring 252*a*.

When the driving shaft 241 is rotated in the opposite direction, the ratchet mechanism (not shown) prevents rotation of the large gear 242. Therefore, the small gear 244 does not reduce the rotating speed of the driving shaft 241. As a consequence, the descending unit 230 is quickly moved up to the original position, thereby enabling another evacuee to escape from an upper story to a lower story.

Once the descending unit 230 moves up to the original position and makes contact with the escape hole cap 210 of the upper story, the support lug 263 of the locking unit 260 protrudes under the descending unit 230 and supports the descending unit 230 against downward movement until and unless the release button 235 is pressed again.

In the emergency escape device according to the second preferred embodiment of the present invention, the module box B accommodating the slowing unit 240 and the returning unit 250 is arranged at one side of the escape hole cap 210. In case where the escape holes P of two upper and lower stories are formed out of alignment, the module box B accommodating the slowing unit 240 and the returning unit 250 may be provided within the platform W arranged on the floor surface of the lower story. In this case, the escape hole cap 210 may be provided with a pulley (not shown) around which the chain 249 of the slowing unit 240 is wound. The first end portion of the chain 249 is fixed to the pulley 248 of the slowing unit 240 while the second end portion of the chain 249 is fixed to the descending unit 230.

Figure 20:
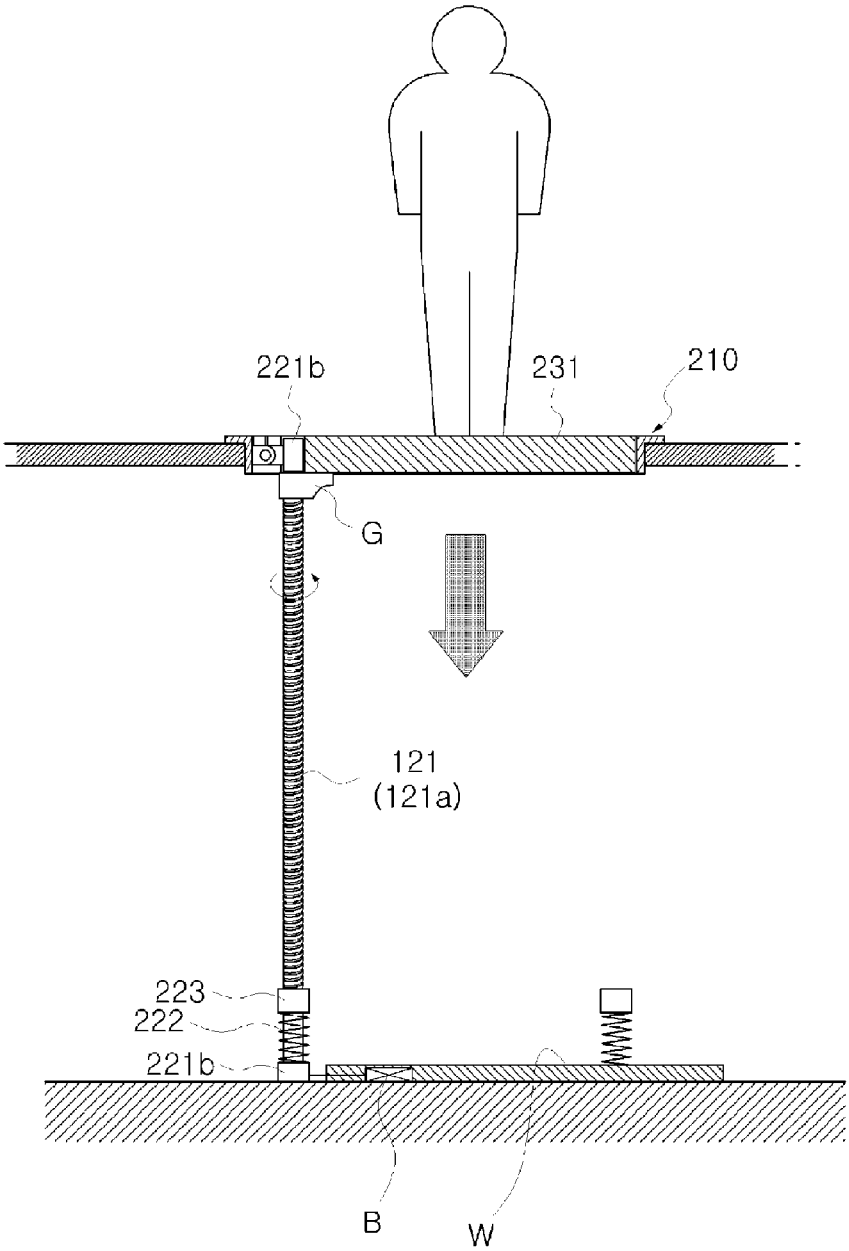
FIGS. 20 and 21 are views showing an emergency escape device according to a third preferred embodiment of the present invention.
Figure 21:
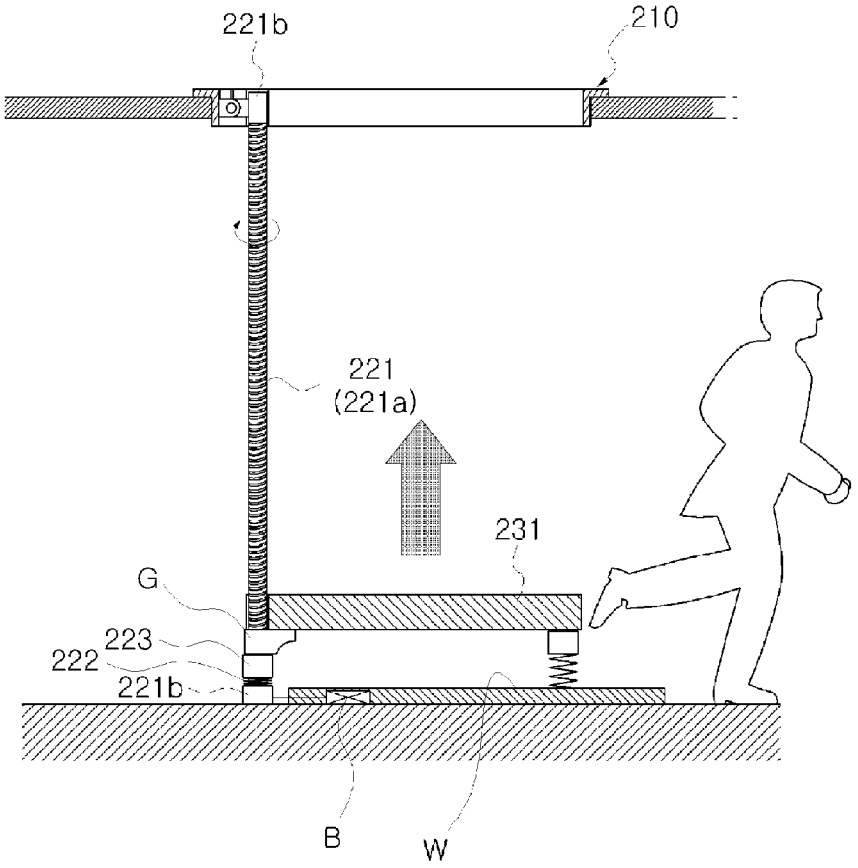

FIGS. 20 and 21 are views showing an emergency escape device according to a third preferred embodiment of the present invention.

As shown in FIGS. 20 and 21, the emergency escape device according to the third preferred embodiment includes: an escape hole cap 210 fitted from above to an escape hole P of a fire evacuation area of a high-rise building so as to cover an inner edge of the escape hole P; a guide unit 220 vertically installed to extend downward from the escape hole cap 210; a descending unit 230 positioned below the escape hole cap 210 and movably attached to the guide unit 220 in such a manner as to descend along the guide unit 220; a slowing unit 240 configured to ensure that the descending unit 230 descends along the guide unit 220 at a reduced speed; a returning unit 250 for returning the descending unit 230 descended along the guide unit 220 to an original position; and a locking unit 260 for keeping the descending unit 230 against downward movement in an upper portion of the guide unit 220. The guide unit 220 includes a ball screw 221*a* having upper and lower end portions rotatably attached to the escape hole cap 210 and a floor surface through bearings 221*b*. The descending unit 230 includes a movable block G threadedly coupled to the ball screw 221*a* so that the descending unit 230 can move up and down as the ball screw 221*a* rotates. The slowing unit 240 includes a driving shaft 241 operatively connected to one end of the ball screw 221*a* through a well-known power transmission mechanism (e.g., helical gears or worm gears).

In this regard, the movable block G and the descending unit 230 are moved up and down depending on the rotating direction of the ball screw 221*a*. During the downward movement of the descending unit 230, the ball screw 221*a* is rotated by the weight of an evacuee getting on the descending unit 230. During the upward movement of the descending unit 230, the ball screw 221*a* is rotated by the loosening operation of the spiral spring 252*a* and the resultant rotation of the driving shaft 241 operatively connected to the ball screw 221*a*.

During the upward and downward movement of the descending unit 230, only the ball screw 221*a* is rotated and the descending unit 230 is prevented from rotation. In other words, the descending unit 230 is not rotated during the upward and downward movement thereof.

The emergency escape device according to the third preferred embodiment remains the same as the emergency escape device according to the first preferred embodiment except the configurations described above.

In the emergency escape device according to the third preferred embodiment, the module box B accommodating the slowing unit 240 and the returning unit 250 may be provided within the platform W arranged on the floor surface of the lower story.

In order to prevent occurrence of a safety accident attributable to the rotation of the ball screw 221*a*, it is preferable to additionally install a sheath for surrounding the ball screw 221*a*. In this case, the sheath needs to have a slot along which the movable block G can move.

Description will now be made on the operation of the emergency escape device according to the third preferred embodiment. If an evacuee gets on the descending unit 230 and if the locking unit 260 releases the descending unit 230, the movable block G and the descending unit 230 are moved down by the weight of the evacuee while rotating the ball screw 221*a*.

As the descending unit 230 is moved down, the spiral spring 252*a* of the winder 252 of the returning unit 250 is tightened by the rotation of the driving shaft 241 operatively connected to the ball screw 221*a*.

If the rotating speed of the large gear 242 is increased during the downward movement of the descending unit 230, the speed reducing pieces 246 arranged in the speed reducing wheel 243 of the small gear 244 meshing with the large gear 242 are displaced radially outward by the centrifugal force. Thus the speed reducing pieces 246 come into contact with the inner surface of the speed reducing cover 247, thereby applying brake to the speed reducing wheel 243 so that the large gear 242 can rotate at a reduced speed. This makes it possible to keep the descending speed of the descending unit 230 substantially constant.

Thereafter, if the evacuee gets off the descending unit 230 moved down to the platform W arranged on the floor surface of a lower story, the weight of the evacuee is removed from the descending unit 230. Thus the descending unit 230 is moved up under the action of the returning unit 250.

At this time, the driving shaft 241 is rotated in the opposite direction so that the spiral spring 252*a* of the winder 252 of the returning unit 250 can be gradually loosened. Consequently, the ball screw 221*a* connected to the driving shaft 241 is rotated, thereby causing the descending unit 230 to move up. In other words, the ball screw 221*a* is rotated by the restoring force of the spiral spring 252*a*, as a result of which the descending unit 230 is moved up.

When the driving shaft 241 is rotated in the opposite direction, the ratchet mechanism (not shown) prevents rotation of the large gear 242. Therefore, the small gear 244 does not reduce the rotating speed of the driving shaft 241. As a consequence, the descending unit 230 is quickly moved up to the original position, thereby enabling another evacuee to escape from an upper story to a lower story.

In the emergency escape devices according to the second and third preferred embodiments, the pulley 248 may be formed into a conical shape to have a small-diameter tip portion and a large-diameter base portion. The first end portion of the chain 249 or the rope wound around the tip portion of the pulley 248 is connected to the descending unit 230. The second end portion of the chain 249 or the rope wound around the base portion of the pulley 248 is fixed to the pulley 248.

During the downward movement of the descending unit 230, the chain 249 is initially unwound from the small-diameter tip portion, thereby preventing the chain 249 from being unwound at an unduly high speed. During the upward movement of the descending unit 230, the chain 249 is initially wound around the large-diameter base portion, thereby enabling the chain 249 to be wound at an increased speed.

With the emergency escape device of the present invention, it is possible to enable rapid escape of evacuees by ensuring that the descending unit installed in the escape hole of the fire evacuation area descends at a reduced speed along the guide unit at a reduced speed when an emergency evacuation situation such as fire or the like occurs in a high-rise building.

Moreover, the emergency escape device of the present invention enables evacuees to successively and rapidly escape from a building by ensuring that the descending unit moved down along the guide unit can quickly come back to the original position.

Inasmuch as the emergency escape device is permanently installed in the fire evacuation area of a building, it is possible for evacuees to rapidly and safely escape from the building in the event of an emergency situation without having to bring a separate emergency escape device to the fire evacuation area. Since the spiral spring type winder is used as the returning unit for returning the descending unit to the original position, it is possible to reduce the manufacturing cost of the emergency escape device and to restrain generation of noises during the operation of the emergency escape device.

What is claimed is:

1. An emergency escape device, comprising:

an escape hole cap fitted to an escape hole of a fire evacuation area of a building;

a guide unit vertically installed below the escape hole cap;

a descending unit slidably attached to the guide unit in such a manner as to descend along the guide unit when an evacuee gets on the descending unit;

a slowing unit configured to ensure that the descending unit descends along the guide unit at a reduced speed, wherein the slowing unit includes a driving shaft connected to the descending unit through a chain; and a returning unit for returning the descending unit descended along the guide unit to an original position, wherein the returning unit includes a spiral spring configured to be tightened as the descending unit descends and to be loosened to cause the descending unit to move upward, a driving gear fixed to one end of the driving shaft and a driven gear meshing with the driving gear and having a rotating shaft, the spiral spring connected to the driven gear, the spiral spring configured to be tightened as the driven gear rotates in a first direction or to be loosened to cause the driven gear to be rotated in a second direction, wherein the slowing unit further includes: a module box; the driving shaft arranged within the module box; a large gear installed within the module box and fixed to the driving shaft; a small gear installed within the module box and driven by the large gear, the small gear provided with a speed reducing wheel; a plurality of speed reducing pieces radially arranged in the speed reducing wheel to receive centrifugal forces; a speed reducing cover fixed to the module box and arranged to surround the speed reducing wheel and the speed reducing pieces; a pulley fixed to the driving shaft to rotate together with the driving shaft; and a chain wound around the pulley, the chain having a first end portion drawn out from a lower portion of the module box and fixed to the descending unit and a second end portion fixed to the pulley, and wherein the descending unit includes: a descending panel having a pair of cutouts corresponding in shape to guide frames of the guide unit; a base frame including a pair of embedment portions embedded in the descending panel, the base frame having guide holes formed in the embedment portions in alignment with the cutouts of the descending panel, the guide frames fitted to the guide holes of the base frame, the base frame further including a connecting portion connected to a first end portion of the chain of the slowing unit; first and second guide rollers rotatablv attached to the embedment portions so as to make rolling contact with the guide frames inserted into the guide holes of the base frame; and a release button provided in the descending panel so as to release the locking unit for having the descending panel locked in an upper portion of one of the guide frames.

2. The emergency escape device of 1, wherein the slowing unit includes a ratchet mechanism provided in the large gear.

3. The emergency escape device of claim 1, wherein the slowing unit includes a centrifugal brake or a magnetic brake.

4. The emergency escape device of claim 1, further includes a locking unit for keeping the descending unit against downward movement in an upper portion of the guide unit.

* * * * *